US007983577B2

(12) United States Patent
Kita et al.

(10) Patent No.: US 7,983,577 B2
(45) Date of Patent: Jul. 19, 2011

(54) IMAGE FORMING APPARATUS

(75) Inventors: Emi Kita, Tokyo (JP); Koichi Kato, Yokohama (JP); Maiko Koeda, Numazu (JP)

(73) Assignee: Ricoh Company Limited, Tokyo (JP)

( * ) Notice: Subject to any disclaimer, the term of this patent is extended or adjusted under 35 U.S.C. 154(b) by 517 days.

(21) Appl. No.: 12/194,649

(22) Filed: Aug. 20, 2008

(65) Prior Publication Data

US 2009/0074432 A1 Mar. 19, 2009

(30) Foreign Application Priority Data

Sep. 14, 2007 (JP) ..... 2007-239822

(51) Int. Cl.
*G03G 15/08* (2006.01)

(52) U.S. Cl. ..... 399/27

(58) Field of Classification Search ..... 399/27, 399/30

See application file for complete search history.

(56) References Cited

U.S. PATENT DOCUMENTS

| | | | | |
|---|---|---|---|---|
| 5,710,960 | A * | 1/1998 | Hart et al. | 399/253 |
| 6,819,897 | B2 | 11/2004 | Kita | |
| 6,856,774 | B2 | 2/2005 | Sampe et al. | |
| 6,873,814 | B2 | 3/2005 | Ohjimi et al. | |
| 6,882,817 | B2 | 4/2005 | Kita | |
| 6,934,484 | B2 | 8/2005 | Suzuki et al. | |
| 7,123,865 | B2 | 10/2006 | Kita | |
| 7,133,629 | B2 | 11/2006 | Kita | |
| 7,184,691 | B2 | 2/2007 | Kita et al. | |
| 7,212,753 | B2 | 5/2007 | Suzuki et al. | |
| 7,389,071 | B2 | 6/2008 | Katsuyama et al. | |
| 2005/0047804 | A1 * | 3/2005 | Kosuge | 399/27 |
| 2005/0254846 | A1 | 11/2005 | Yura et al. | |
| 2006/0134540 | A1 | 6/2006 | Kondo et al. | |
| 2007/0077098 | A1 | 4/2007 | Katsuyama et al. | |
| 2007/0122204 | A1 | 5/2007 | Kita | |
| 2007/0140747 | A1 | 6/2007 | Kita et al. | |
| 2007/0212119 | A1 | 9/2007 | Kurenuma et al. | |
| 2008/0063433 | A1 | 3/2008 | Miyamoto et al. | |
| 2008/0081273 | A1 * | 4/2008 | Murakami et al. | 430/48 |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |

FOREIGN PATENT DOCUMENTS

| | | |
|---|---|---|
| JP | 2000-47465 | 2/2000 |
| JP | 2000-98721 | 4/2000 |

* cited by examiner

*Primary Examiner* — David M Gray
*Assistant Examiner* — Rodney Bonnette
(74) *Attorney, Agent, or Firm* — Oblon, Spivak, McClelland, Maier & Neustadt, L.L.P.

(57) ABSTRACT

An image forming apparatus including an image bearing member; a developing device forming a toner image; a toner supplying device including a toner container, a toner feeding passage, a pump, in which a first member is moved while rubbing a second member to feed a developer supplement including at least the toner, and a residual toner detector detecting the amount of the developer supplement remaining in the toner container. Even after the toner container achieves a near empty state, image forming operations are continued as long as a predetermined condition is satisfied while changing the pump's condition such that the pump is stopped, the ratio of the pump stopping period to the pump driving period is set to be greater than that before the near-empty detection, or the pump stopping period and the pump driving period are set to be longer than those before the near-empty detection.

12 Claims, 12 Drawing Sheets

IMAGE FORMING APPARATUS

BACKGROUND OF THE INVENTION

1. Field of the Invention

The present invention relates to an image forming apparatus having a toner supplying device for supplying a developer supplement (a toner, a premix toner including a toner and a carrier or the like) including at least a toner from a toner container to a developing device.

2. Discussion of the Background

Image forming apparatus typically use a toner supplying device for supplying a developer supplement (a toner, a premix toner including a carrier and a toner or the like) including at least a toner from a toner container to a developer containing portion of a developing device of the apparatus. Japanese patent 3,917,761 (i.e., published unexamined Japanese patent application No. 2000-47465) and published unexamined Japanese patent application No. 2004-226524 (which corresponds to U.S. Pat. No. 7,123,865) have disclosed toner supplying devices which supply a toner using a screw pump. Such toner supplying devices include a toner feeding passage, and a screw pump, which feeds the toner in the toner container to the developer containing portion by suction through the toner feeding passage.

Screw pumps typically include a stator which is made of an elastic material and which has a spiral groove on the inner surface thereof, and a rotor which is made of a metal and which has a spiral form and rotates inside the stator. In such screw pumps, a closed space is formed by the inner surface of the stator, the surface of the rotor and the contact portion between the rotor and the stator. When the rotor rotates, the rotor rubs the stator while a contact portion of the rotor moves relative to the stator, and therefore, the closed space moves in a direction parallel to the axis of the rotor (i.e., the rotor axis direction). The screw pumps have an opening at both the ends thereof in the rotor axis direction, i.e., a first opening present on the uppermost stream side relative to the moving direction of the closed space, and a second opening present on the most downstream side. The first opening serves as a suction opening (i.e., entrance), and the second opening serves as an exhaust opening (i.e., an exit). The first opening is connected with a toner container via a feeding tube serving as a feeding passage. The second opening is connected with a developer containing portion of a developing device directly or via another feeding passage or a hopper.

When such a screw pump is set in a toner supplying device and then driven, a negative pressure is generated at the suction opening due to movement of the closed space caused by rotation of the rotor, and thereby the toner in a toner container is sucked, resulting in entering of the toner into the space between the stator and rotor of the screw pump. The toner thus entering into the screw pump is moved toward the exhaust opening due to movement of the closed space while contained in the closed space. The toner thus fed to the exhaust opening of the screw pump is supplied to a developer containing portion of a developing device directly or via a feeding passage or a hopper.

A toner supplying device having such a screw pump sucks and feeds a toner using the screw pump. Therefore, even when the feeding tube serving as a feeding passage is curved or raised at an acute angle, the toner can be stably fed. Accordingly, by using a screw pump, the positional flexibility of the toner supplying device and developing device can be enhanced, namely the positions of the toner supplying device and developing device can be changed relatively freely. In addition, the feeding tube can be arranged between parts set in the vicinity of the toner supplying device. Therefore, the image forming apparatus can be miniaturized.

On the other hand, recently image forming apparatus are requested to save energy. In order to save energy, fixing temperature in heat fixing devices used for the image forming apparatus tends to be decreased. Therefore, image forming apparatus using a low temperature fixable toner, which can be fixed at a relatively low fixing temperature, have been proposed.

Recent image forming apparatus typically have a function such that when the toner in the toner container thereof is exhausted, a message "toner is nearly empty" is displayed in the operation panel of the image forming apparatus. Several methods have been used for detecting that toner is nearly empty. One of the near-empty detection methods is that a property (such as the amount of toner present in a sub-hopper) influenced by the amount of toner fed by the screw pump is measured at the main body of the image forming apparatus to determine whether the toner in the toner container is nearly empty. Specifically, this near-empty detection method is such that when a sensor determines that the amount of toner present in the sub-hopper is smaller than a predetermined amount, a controller orders to perform a toner supplying operation. Even when the amount of toner in the sub-hopper does not reach to the predetermined amount even after a predetermined number of toner supplying operations are performed, the controller determines that the toner container is nearly empty.

There are image forming apparatus, which continue image forming operations even after a near-empty detection as long as predetermined conditions are satisfied (for example, conditions such that the number of copies produced thereafter is within a predetermined range, and/or the image forming time and/or the toner consumption thereafter are within predetermined ranges are satisfied). In this regard, the number of additional image forming operations is determined as the number of images which can be produced without any problems even when the toner is not supplied from the toner container. It is common for conventional image forming apparatus that even when a near-empty message is displayed, a small amount of toner is present in the toner container. Therefore, such image forming apparatus typically perform the toner supplying operation in such additional image forming operations to reduce the amount of the residual toner in the toner container.

However, when screw pumps feed a low temperature fixable toner, a problem in that the suction power of the screw pumps deteriorate tends to occur. The cause for the problem is considered as follows.

When a rotor is rotated wile rubbing a stator in a screw pump, heat is generated due to the friction between the rotor and the stator. In addition, the rotor and stator form a closed space, and therefore the thus generated heat does not easily escape from the screw pump, resulting in increase of the internal temperature of the screw pump. In this regard, when a considerable amount of toner is present in the toner container, increase of the internal temperature of the screw pump is prevented. This is because a sufficient amount of toner is sucked by the screw pump, and the toner in the screw pump absorbs the heat and is then discharged from the screw pump, resulting in escape of the frictional heat from the screw pump.

In contrast, when the toner present in the toner container is such a small amount that a near-empty message is displayed, the amount of toner sucked by the screw pump is little. The quantity of heat discharged from the screw pump together with the toner decreases. If the toner supplying operation is performed by the screw pump similarly to the case where a sufficient amount of toner is present in the toner container, the internal temperature of the screw pump increases.

When the toner is a low temperature fixable toner, a problem in that the toner is melted in the screw pump tends to occur. When the toner is melted and then the internal temperature of the screw pump decreases after the screw pump is stopped, the toner is fixed to the stator and rotor. In this case, when the screw pump is driven again, the stator (typically made of an elastic material) is easily abraded by the toner, which is fixed to the contact portion between the rotor and the stator and which serves as an abrasive. Thereby, the sealing property of the screw pump is deteriorated due to the abraded portion of the stator, resulting in deterioration of the suction power of the screw pump.

This problem is not specific to such screw pumps, and may occur in any pumps in which a first member is moved while rubbing a second member contacted with the first member to generate a negative pressure at the suction opening thereof.

Because of these reasons, a need exists for a toner supplying method (or an image forming apparatus having a toner supplying device), which does not cause the above-mentioned problem in that the suction power of a pump (such as screw pumps) is deteriorated due to fixation of a low temperature fixable toner to the pump.

SUMMARY OF THE INVENTION

As an aspect of the present invention, an image forming apparatus, which performs image forming operations to produce an image, is provided. The image forming apparatus includes:

an image bearing member configured to bear an electrostatic image thereon;

a developing device, which has a developer containing portion containing a developer including at least a toner and which is configured to develop the electrostatic image with the developer to form a toner image on the image bearing member; and a toner supplying device configured to supply a developer supplement including at least the toner (preferably, a premix toner including a carrier and the toner when the developer is a two-component developer) to the developer containing portion.

The toner supplying device includes:

a toner container containing the developer supplement;

a feeding passage configured to connect the toner container with the developer containing portion;

a pump, in which a first member is moved while rubbing a second member to feed the developer supplement from the toner container to the developer containing portion through the feeding passage; and a residual toner detector configured to detect the amount of the developer supplement remaining in the toner container to determine whether the toner container is in a near-empty state.

Even after the residual toner detector detects that the toner container is in a near-empty detection, the image forming apparatus continues the image forming operations as long as a predetermined condition is satisfied (for example, until a predetermined amount of copies are produced, or the toner container is replaced with a new toner container) while stopping the pump.

Instead of stopping the pump, the pump may perform control of drive such that driving and stopping are repeatedly performed. In this case, after the residual toner detector makes the near-empty detection, the image forming apparatus continues the image forming operations as long as the predetermined condition is satisfied while changing the condition of the pump such that the ratio (S/D) of the pump stopping period (S) to the pump driving period (D) is greater than that before the residual toner detector makes the near-empty detection or the pump stopping period (S) and the pump driving period (D) are longer than the respective times (S) and (D), respectively, before the residual toner detector makes the near-empty detection.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, a tandem color laser copier, which is one example of the image forming apparatus of the present invention and in which plural photoreceptors are arranged in parallel, will be explained.

Figure 1:
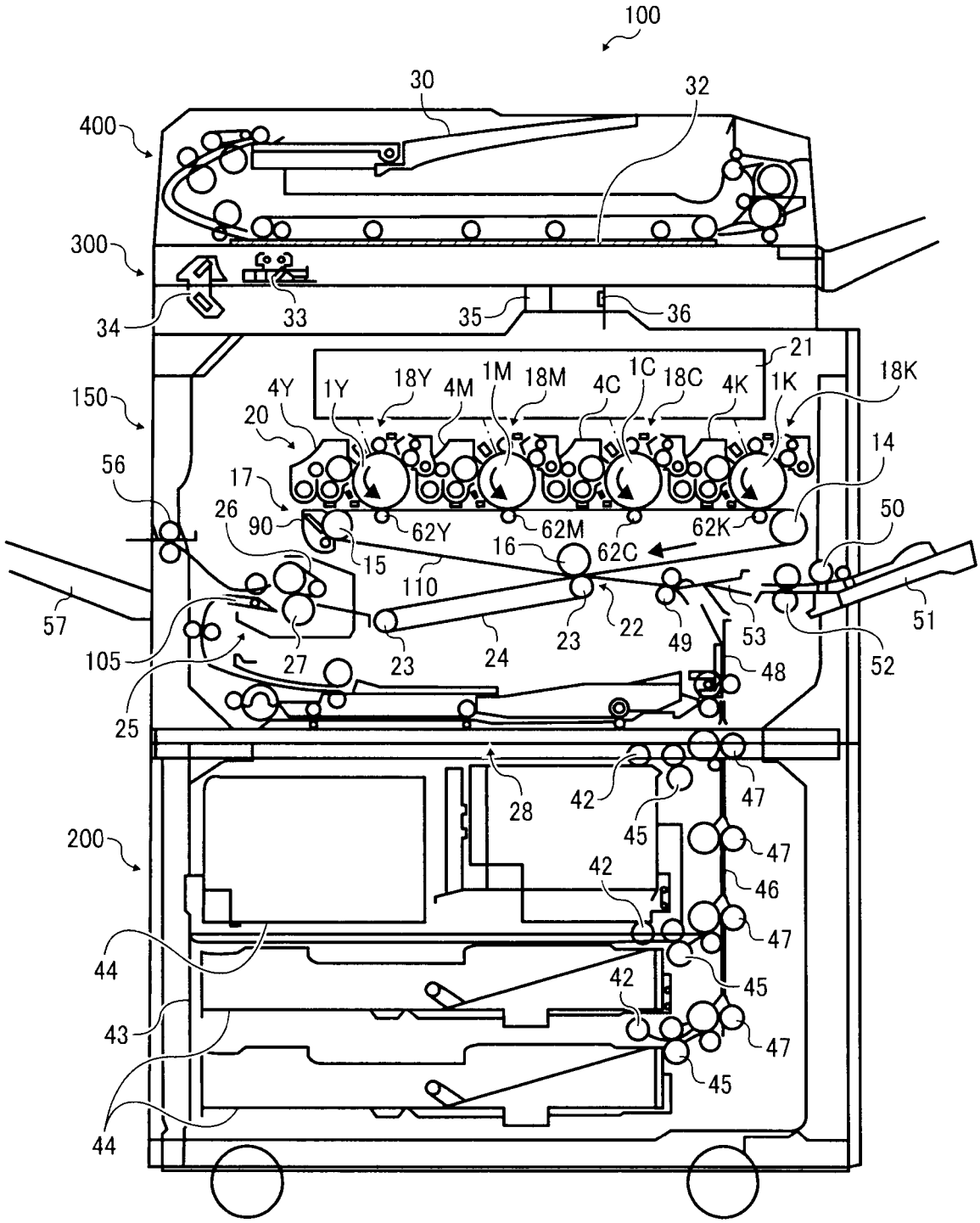
FIG. 1 is a schematic cross-sectional view illustrating an example (a copier) of the image forming apparatus of the present invention.

FIG. 1 is a schematic view illustrating a tandem color laser copier (hereinafter referred to as a copier). Referring to FIG. 1, a copier 100 includes a printing section 150, a receiving material feeding section 200 on which the printing section 150 is arranged, a scanner 300 which is fixed on the printing section 150, and an automatic document feeder (ADF) 400 which is fixed on the scanner 300.

The printing section 150 includes an image forming unit 20 including four process cartridges 18Y, 18M, 18C and 18K for forming yellow (Y), magenta (M), cyan (C) and black (K) color images, respectively. In this regards, a member with a suffix of Y, M, C or K is a member used for forming a yellow, magenta, cyan or black color image, respectively. The suffix is sometimes omitted if it is not necessary for explanation. The printing section 150 further includes an optical image writing unit 21, an intermediate transfer unit 17, a secondary transfer device 22, a pair of registration rollers 49, and a belt-type fixing device 25.

The optical image writing unit 21 includes a light source, a polygon mirror, an f-θ lens, a reflection mirror, etc., (which are not shown in FIG. 1), and irradiates a photoreceptor (explained later) with laser light on the basis of image data.

Each of the process cartridges 18(Y, M, C and K) includes a photoreceptor 1, a charger, a developing device 4, a drum cleaning device for cleaning the photoreceptor 1, a discharger for decaying charges remaining on the photoreceptor 1, etc.

Hereinafter, the process cartridge 18Y for forming yellow color images will be explained. At first, the circumferential surface of the photoreceptor 1Y is charged with a charger (not shown). Next, the optical image writing unit 21 irradiates the charged photoreceptor 1Y with laser light, which has been modulated and deflected, thereby decaying the charges of the irradiated portions of the photoreceptor, resulting in formation of an electrostatic latent image for a yellow image on the photoreceptor. Next, the developing device 4Y develops the electrostatic latent image with a developer including a yellow toner, resulting in formation of a yellow toner image on the photoreceptor 1Y.

The thus prepared yellow toner image is then transferred onto an intermediate transfer belt 110. This transfer process is hereinafter referred to as primary image transfer. After the primary image transfer, the surface of the photoreceptor 1Y is cleaned with the drum cleaning device to remove residual toner particles from the surface.

The thus cleaned photoreceptor 1Y is then discharged with the discharger to remove residual charges therefrom. The circumferential surface of the photoreceptor 1Y is then charged with the charger so that the photoreceptor has an initial state, i.e., the photoreceptor is ready for the next image forming operations. The same image forming operations are performed on the other photoreceptors 1M, 1C and 1K, resulting in formation of magenta, cyan and black toner images on the respective photoreceptors 1M, 1C and 1K.

Next, the intermediate transfer unit 17 will be explained.

The intermediate transfer unit 17 includes the intermediate transfer belt 110, a belt cleaning device 90, a tension roller 14, a driving roller 15 (which is driven with a belt driving motor (not shown)), a secondary transfer backup roller 16, four primary transfer bias rollers 62Y, 62M, 62C and 62K, etc.

The intermediate transfer belt 110 is supported while tightly stretched by plural rollers including the tension roller 14, and is clockwise rotated endlessly with the driving roller 15. The four primary transfer bias rollers 62(Y, M, C and K) are arranged so as to contact the inner surface of the intermediate transfer belt 110, and receive a primary transfer bias from a power source (not shown). The four primary transfer bias rollers 62 press the intermediate transfer belt 110 toward the photoreceptors 1, resulting in formation of four primary transfer nips. At the primary transfer nips, primary transfer electric fields are formed between the photoreceptors 1 and the primary transfer rollers 62 due to the primary transfer bias applied to the primary transfer rollers.

The yellow toner image formed on the photoreceptor 1Y is primarily transferred onto the intermediate transfer belt 110 due to the primary transfer electric field and the nip pressure. Similarly, the magenta, cyan and black toner images are sequentially transferred onto the intermediate transfer belt to be overlaid on the yellow toner image, resulting in formation of a combined four color toner image on the intermediate transfer belt 110.

The combined four color toner image formed on the intermediate transfer belt 110 is then transferred onto a paper sheet serving as a receiving material (i.e., secondary image transfer) at a secondary transfer nip (explained later). The surface of the intermediate transfer belt 110 is cleaned with the belt cleaning device 90 (which sandwiches the intermediate transfer belt 110 with the driving roller 15) after the secondary image transfer to remove residual toner particles therefrom.

Next, the secondary transfer device 22 will be explained.

The secondary transfer device 22 is located under the intermediate transfer unit 17, and includes two tension rollers 23 and a feeding belt 24, which is stretched by the tension rollers 23. The feeding belt 24 is counterclockwise rotated while driven by at least one of the tension rollers 23. The tension roller 23 on the right side in FIG. 1 and the secondary transfer backup roller 16 sandwich the intermediate transfer belt 110 and the feeding belt 24, resulting in formation of a secondary transfer nip at which the intermediate transfer belt 110 and the feeding belt 24 are contacted with each other. A secondary transfer bias having a polarity opposite to that of the charged toner is applied to the right tension roller 23 from a power source (not shown), resulting in formation of a secondary transfer electric field. Due to this secondary transfer electric field, the combined color toner image on the intermediate transfer belt 110 is electrostatically moved toward the feeding belt 24.

On the other hand, a paper sheet serving as a receiving material is fed from the receiving material feeding section 200 to the pair of registration rollers 49 as explained later in detail. The pair of registration rollers 49 timely feed the paper sheet to the secondary transfer nip. The combined color toner image on the intermediate transfer belt 110 is transferred onto the paper sheet at the secondary transfer nip due to the secondary transfer electric field and the secondary transfer nip pressure. In this regard, a transfer method in which the paper sheet may be charged in a noncontact manner can be used instead of the above-mentioned transfer method in which a secondary transfer bias is applied to the right tension roller 23.

The receiving material feeding section 200 includes plural cassettes 44, which are arranged in the vertical direction while overlying with a space therebetween as illustrated in FIG. 1. In each cassette 44, a feeding roller 42 is contacted with the uppermost paper sheet (serving as a receiving material) in the cassette. By rotating the feeding roller 42, the uppermost paper sheet is fed toward a feeding passage 46.

The feeding passage 46 includes plural pairs of rollers 47 and the pair of registration rollers 49, which are located at the end of the feeding passage 46. The paper sheet is fed to the pair of registration rollers 49 by the plural pairs of rollers 47 through a passage 48. The paper sheet is then pinched by the pair of registration rollers 49. On the other hand, the combined color toner image fed toward the secondary transfer nip by the rotated intermediate transfer belt 110. The pair of registration rollers 49 timely feed the paper sheet toward the secondary transfer nip so that the combined color toner image is contacted with a proper position of the paper sheet at the secondary transfer nip. Therefore, the combined color toner image is transferred onto the proper position of the paper sheet, resulting in formation of a full color toner image on the paper sheet. The paper sheet bearing the full color toner image thereon is then fed to the fixing device 25 by the feeding belt 24.

The fixing device 25 includes a belt unit in which a fixing belt 26 is rotated endlessly while stretched by two rollers, and a pressure roller 27 pressed to one of the two rollers. The fixing belt 26 and the pressure roller 27 are contacted with each other to form a fixation nip. The paper sheet fed by the feeding belt 24 is pressed at the fixation nip. The one of the two rollers, which is pressed by the pressure roller 27, has a heat source therein to heat the fixing belt 26. Therefore, the paper sheet is pressed and heated at the fixation nip, resulting in fixation of the full color toner image on the paper sheet.

The paper sheet bearing the fixed full color image thereon is discharged from the main body of the image forming apparatus to a tray 57 serving as a stacking member by a discharging roller 56. Alternatively, when another image is formed on the backside of the paper sheet, the paper sheet is fed toward the secondary transfer nip by a reversing member 28. Numeral 105 denotes a switching pick which reverses the paper sheet to the secondary transfer nip.

In order to prepare a copy of an original document, at first the original document is set on a table 30 of the ADF 400. When the original document is a page of a book-form document, the page of the book-form original document is directly set on a glass table 32, which can be exposed by opening the ADF 400. After the book-form original document is set on the glass table 32, the ADF 400 is closed to press the book-form original document toward the glass table.

When a copy start switch is pressed after the original document is set, an original document reading operation of the scanner 300 is started. When the original document is set on the table 30 of the ADF 400, the original document is fed to the glass table 32 and then the original document reading operation is started. In the original document reading operation, a first traveling member 33 and a second traveling member 34 start to travel, and light is emitted from a light source, which is provided on the first traveling member 33, toward the original document. Reflection light reflected from the original document is reflected off a mirror provided in the second traveling member 34, followed by entering into a reading sensor 36 after passing through a focusing lens 35. Thus, the reading sensor 36 obtains image information from the incident light.

In parallel to the original document reading operation, the devices in the process cartridges 18, the intermediate transfer unit 17, the secondary transfer device 22, and the fixing device 25 are driven to operate. The optical image writing unit 21 is also driven to operate, and irradiates the charged photoreceptors 1 with imagewise light (i.e., an optical image having the image information obtained by the reading sensor 36), resulting in formation of electrostatic latent images on the photoreceptors. As mentioned above, the electrostatic latent images are developed with the respective developers including the respective color toners, resulting in formation of color toner images on the respective photoreceptors 1.

In addition, at almost the same time when the original document reading operation is started, a receiving material feeding operation is started in the receiving material feeding section 200. In the receiving material feeding operation, one of the feeding rollers 42 is rotated to feed a paper sheet contained in one of the cassettes 44 arranged in a receiving material bank 43. In this regard, when plural paper sheets are fed, the paper sheets are separated from each other by a separation roller 45. The paper sheet is fed to the feeding passage 46, and is then fed to the secondary transfer nip by the plural pairs of feeding rollers 47. Alternatively, the receiving material feeding operation may be performed using a manual feed tray 51. In this case, a feeding roller 50 is rotated to feed paper sheets set on the manual feed tray 51 one by one. The paper sheets are separated from each other by a separation roller 52, and the paper sheet is fed to a manual feeding passage 53.

When a multi-color image including two or more color images is prepared, the upper portion of the intermediate transfer belt 110 is stretched by the rollers so as to be contacted with all the photoreceptors 1Y, 1M, 1C and 1K. However, when a monochrome black image is prepared, the upper portion of the intermediate transfer belt 110 is declined so as to be separated from the photoreceptors 1Y, 1M, and 1C. In addition, among the four photoreceptors 1, only the photoreceptor 1K for black images is counterclockwise rotated so that a black toner image is formed on the photoreceptor 1K. In this case, not only the photoreceptors 1Y, 1M and 1C, but also the developing devices 4Y, 4M and 4C are stopped, to prevent wasteful abrasion of the photoreceptors 1Y, 1M and 1C and wasteful consumption of the Y, M and C developers.

The copier 100 includes a controller (not shown in FIG. 1) including a CPU configured to control the operations of the various devices included in the copier, and an operation panel (not shown) including a display and keys. The operator can provide an instruction to the controller by key input. For example, the operator can select a one-side print mode among three one-side print modes, i.e., direct discharge mode, reverse discharge mode and decurling reverse discharge mode.

Figure 2:
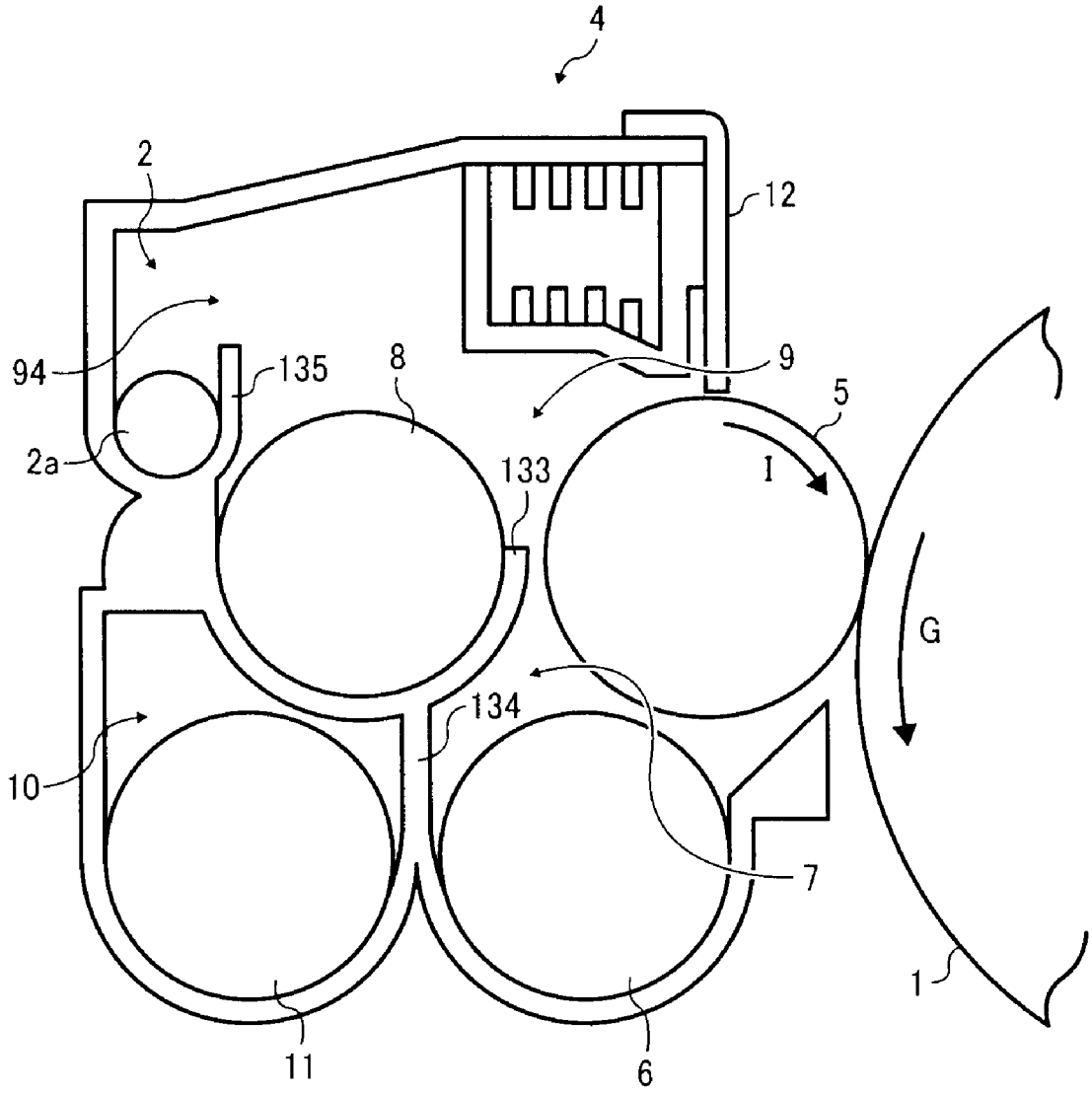
FIG. 2 is a schematic cross-sectional view illustrating the developing device and the image bearing member (photoreceptor) of the image forming apparatus illustrated in FIG. 1.

FIG. 2 is an enlarged view illustrating a portion of the process cartridge 18, which portion includes the developing device 4 and the photoreceptor 1. Since the process cartridges 18Y, 18M, 18C and 18K are the same except for the color of the toner used for developing, the suffixes Y, M, C and K are omitted in FIG. 2.

As illustrated in FIG. 2, the photoreceptor 1 is rotated in a direction indicated by an arrow G. The surface of the photoreceptor is charged with a charger (not shown). The charged surface of the photoreceptor 1 is exposed to imagewise light emitted from the optical image writing unit 21, resulting in formation of an electrostatic latent image on the photoreceptor 1. The electrostatic latent image is developed with the toner in the developer supplied from the developing device 4, resulting in formation of a toner image on the photoreceptor 1.

The developing device 4 includes a developing roller 5, which serves as a developer bearing member and which is rotated in a direction indicated by an arrow I to supply the developer to the electrostatic latent image on the photoreceptor 1, and a supplying screw 8, which serves as a developer supplying member and which supplies the developer to the developing roller 5 while feeding the developer toward the inner portion thereof (i.e., in a direction of from the front side of the paper sheet on which FIG. 2 is printed to the backside of the paper sheet). The supplying screw 8 includes a rotation shaft and a blade provided on the rotation shaft, and serves as a developer feeding screw, which feeds the developer in the axis direction thereof by rotating.

A doctor blade 12 is provided on a downstream side from the opposed position, at which the developing roller 5 and the supplying screw 8 are opposed, relative to the rotation direction I of the developing roller. The doctor blade 12 serves as a developer layer thickness controlling member configured to control the thickness of the developer layer on the developing roller 5.

The developing device 4 further includes a collection screw 6, which is provided on a downstream side from the opposed position, at which the developing roller 5 and the photoreceptor 1 are opposed, relative to the rotation direction I of the developing roller. The collection screw 6 collects the developer used for developing and feeds the collected developer toward the inner portion of the collection screw 6 (i.e., in the same direction as that of the feeding direction of the supplying screw 8). As illustrated in FIG. 2, a developer supplying passage 9 is provided on one side of the supplying screw 8, and a developer collection passage 7 is provided on an upper side of the collection screw 6.

The developing device 4 further includes a developer agitating passage 10, which is located below the developer supplying passage 9 and is parallel to the developer collection passage 7. The developer agitating passage 10 includes an agitation screw 11 configured to feed the developer in the direction opposite to the developer feeding direction of the supplying screw 8 while agitating the developer. The developer agitating passage 10 is separated from the developer supplying passage 9 with a portion of a first partition wall 133. An opening is formed on both ends of the first partition wall 133 in the developer feeding direction of the supplying screw 8, and therefore the developer supplying passage 9 and the developer agitating passage 10 are communicated with each other through the openings.

The developer supplying passage 9 is separated from developer collection passage 7 with another portion of the first partition wall 133, which portion includes no opening.

The developer agitating passage 10 is separated from the developer collection passage 7 with a second partition wall 134. The second partition wall 134 has one opening on an uppermost stream side in the developer feeding direction of the supplying screw 8, and thereby the developer agitating passage 10 is communicated with the developer collection passage 7. The developer containing portion of the developing device 4 is constituted of the developer supplying passage 9, the developer collection passage 7 and the developer agitating passage 10.

The developer used for developing electrostatic latent images is collected with the developer collection passage 7 and the collected developer is fed in the direction opposite to the developer feeding direction of the supplying screw 8. The thus fed developer is then fed to the agitating passage 10 through one of the openings of the first partition wall 133, which is located on a portion corresponding to a non-image-forming area of the photoreceptor 1 and which is located on the downstream side relative to the developer feeding direction of the developer collection passage 7. At a portion of the developer agitating passage 10, which is located on an upstream side relative to the developer feeding direction of the developer agitating passage 10 and which faces one of the openings of the first partition wall 133, a premixed toner including a carrier and a toner is supplied to the developer agitating passage 10 from a toner supplying opening provided above the developer agitating passage 10.

Next, flow of the developer in the three developer passages 9, 7 and 10 will be explained.

Figure 3:
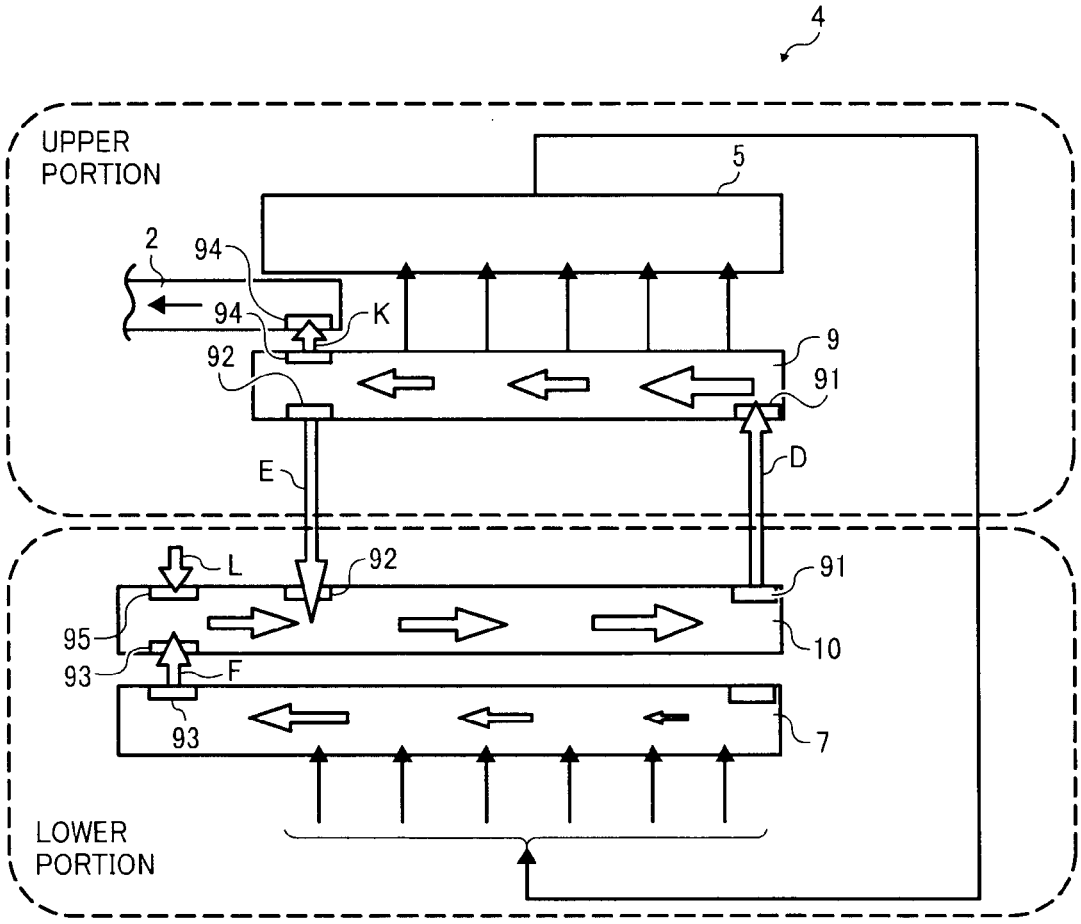
FIG. 3 is a schematic view illustrating flow of the toner in the developing device.

FIG. 3 is a schematic view for explaining flow of the developer in the three developer passages. In FIG. 3, arrows indicate the moving directions of the developer.

The developer is supplied from the developer agitating passage 10 to the developer supplying passage 9 through an opening 91 as indicated by an arrow D. The developer supplying passage 9 supplies the developer to the developing roller 5 while feeding the developer in the developer feeding direction of the supplying screw 8 as indicated by three outline arrows. The developer (i.e., excessive developer), which is supplied to the developing roller 5 but is not used for developing until the developer is fed to the downstream side of the supplying passage 9, is returned to the developer agitating passage 10 through another opening 92 as indicated by an arrow E.

On the other hand, the developer fed to the developer collection passage 7 from the developing roller 5 is fed by the collection screw 6. The developer (collected developer) fed to the downstream side of the developer collection passage 7 is fed to the developer agitating passage 10 through a collection-use opening 93 as indicated by an arrow F.

In the developer agitating passage 10, the excessive developer and the collected developer are agitated, and the mixture is fed to the downstream side of the developer agitating passage 10 (i.e., the upstream side of the developer supplying passage 9) with the agitating screw 11. The thus fed mixture developer is fed to the developer supplying passage 9 through the opening 91 of the first partition wall 133 as indicated by the arrow D.

In addition, a premix toner, which includes the carrier and the toner and which serves as the developer supplement, is supplied to the developer agitating passage 10, if necessary. The premix toner is mixed with the collected developer, and the excess developer, and the mixture developer is fed to the downstream side of the developer agitating passage 10 (i.e., the upstream side of the developer supplying passage 9) with the agitating screw 11 as mentioned above. A toner concentration sensor (not shown) is provided on a lower portion of the developer agitating passage 10. Depending on the output of the toner concentration sensor, the developing device 4 performs a toner supplying operation (mentioned later) in which the developer supplement (i.e., toner or premix toner) is supplied from the toner container.

The developing device 4 illustrated in FIG. 3 includes the developer supplying passage 9 and the developer collection passage 7 so that developer supplying and developer collection are performed in the different passages. Therefore, it is impossible that the developer, which has been used for developing, is mixed with the developer in the developer supplying passage 9. Therefore, occurrence of a problem in that the developer located on the downstream side of the developer supplying passage 9 has a lower toner concentration than the developer in the other portions of the developer supplying passage 9 can be prevented.

In addition, the developing device 4 includes the developer collection passage 7 and the developer agitating passage 10 so that developer collection and developer agitation are performed in the different passages. Therefore, the developer, which has been used for developing, never falls into the developer in process of agitating. Thus, the well agitated developer is supplied to the developer supplying passage 9. Therefore, the developer in the developer supplying passage 9 has a constant toner concentration and charge in the developer feeding direction, thereby forming toner images having a constant image density on the photoreceptors 1.

Next, the way to supply the developer supplement (i.e., toner or premix toner) to the three developer passages 9, 10 and 7 will be explained referring to FIG. 4, which is a schematic perspective view illustrating the developing device 4. Hereinafter, an example, in which a premix toner including a carrier and a toner is supplied as the developer supplement from a toner container to the developing device, will be explained. However, the present invention is not limited thereto, and a toner may be supplied as the developer supplement instead of a premix toner.

Figure 4:
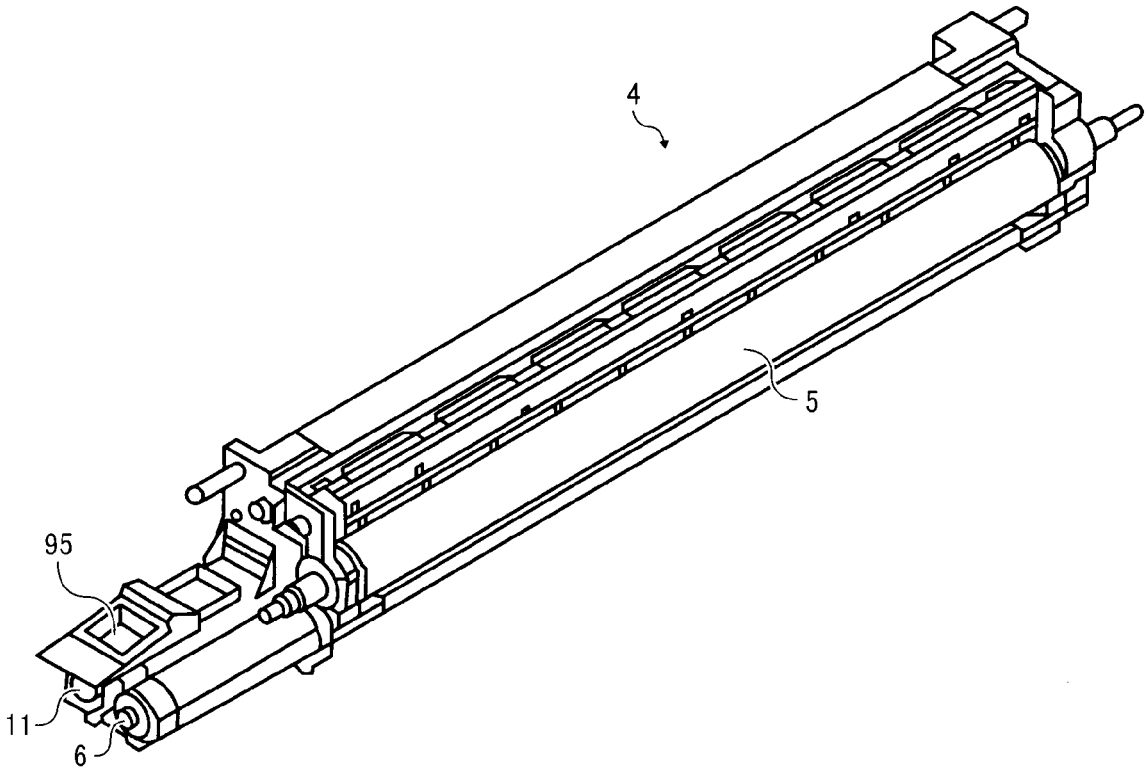
FIG. 4 is a schematic perspective view illustrating the developing device of the image forming apparatus illustrated in FIG. 1.

As illustrated in FIG. 4, a toner supplying opening 95 configured to supply a premix toner is provided over an upstream portion of the developer agitating passage 10 having the agitating screw 11 relative to the developer feeding direction in the developer agitating passage 10. The toner supplying opening 95 is located outside of the side end of the developing roller 5. The location of the toner supplying opening 95 is not limited to the above-mentioned location, and may be formed over a downstream portion of the developer collection passage 7 relative to the developer feeding direction in the developer collection passage 7.

In addition, the toner supplying opening 95 may be formed over the collection-use opening 93 (illustrated in FIG. 3) through which the developer is transferred. In this case, the premix toner can be efficiently mixed with the developer because the developer is well mixed at the collection-use opening 93.

Next, a toner supplying device, which serves as a developer supplying device configured to supply the premix toner to the developing device through the toner supplying opening 95, will be explained by reference to FIGS. 5-9.

Figure 5:
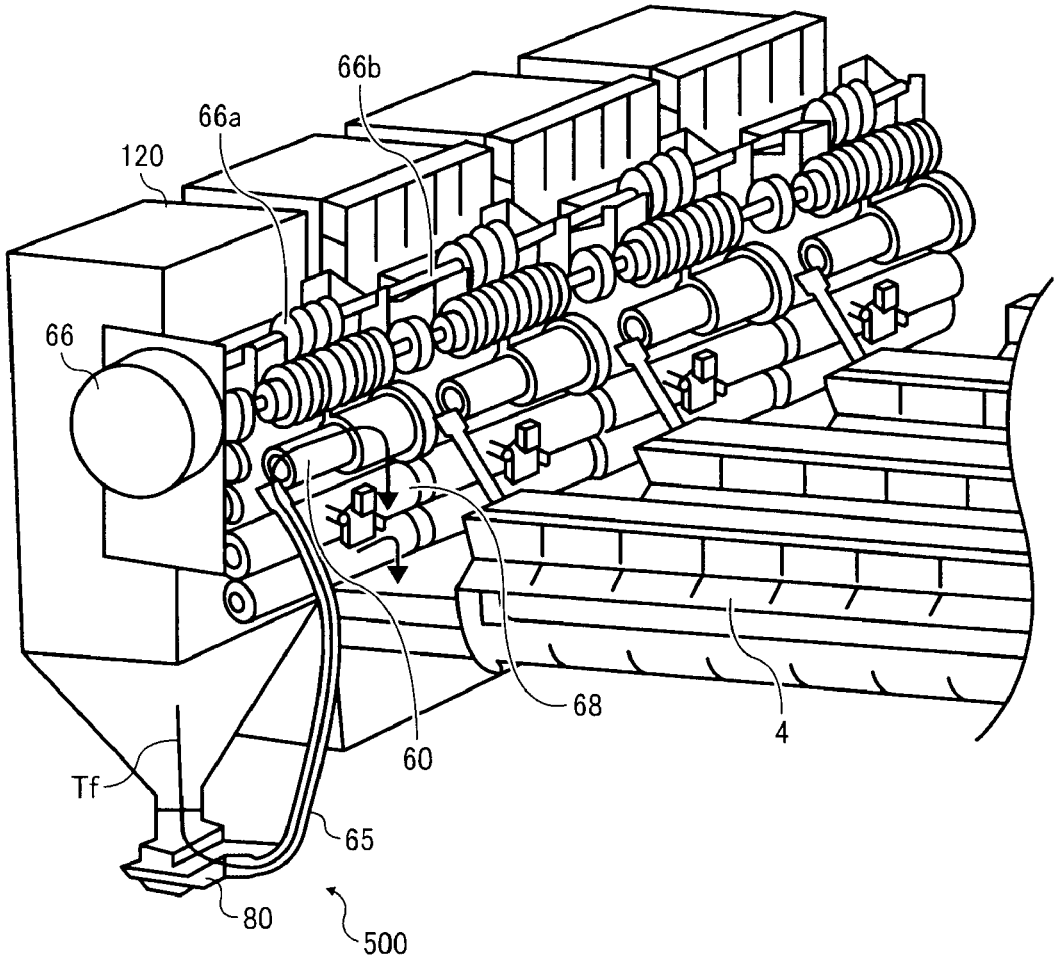
FIG. 5 is a schematic perspective view illustrating the toner supplying device of the image forming apparatus illustrated in FIG. 1.
Figure 6:
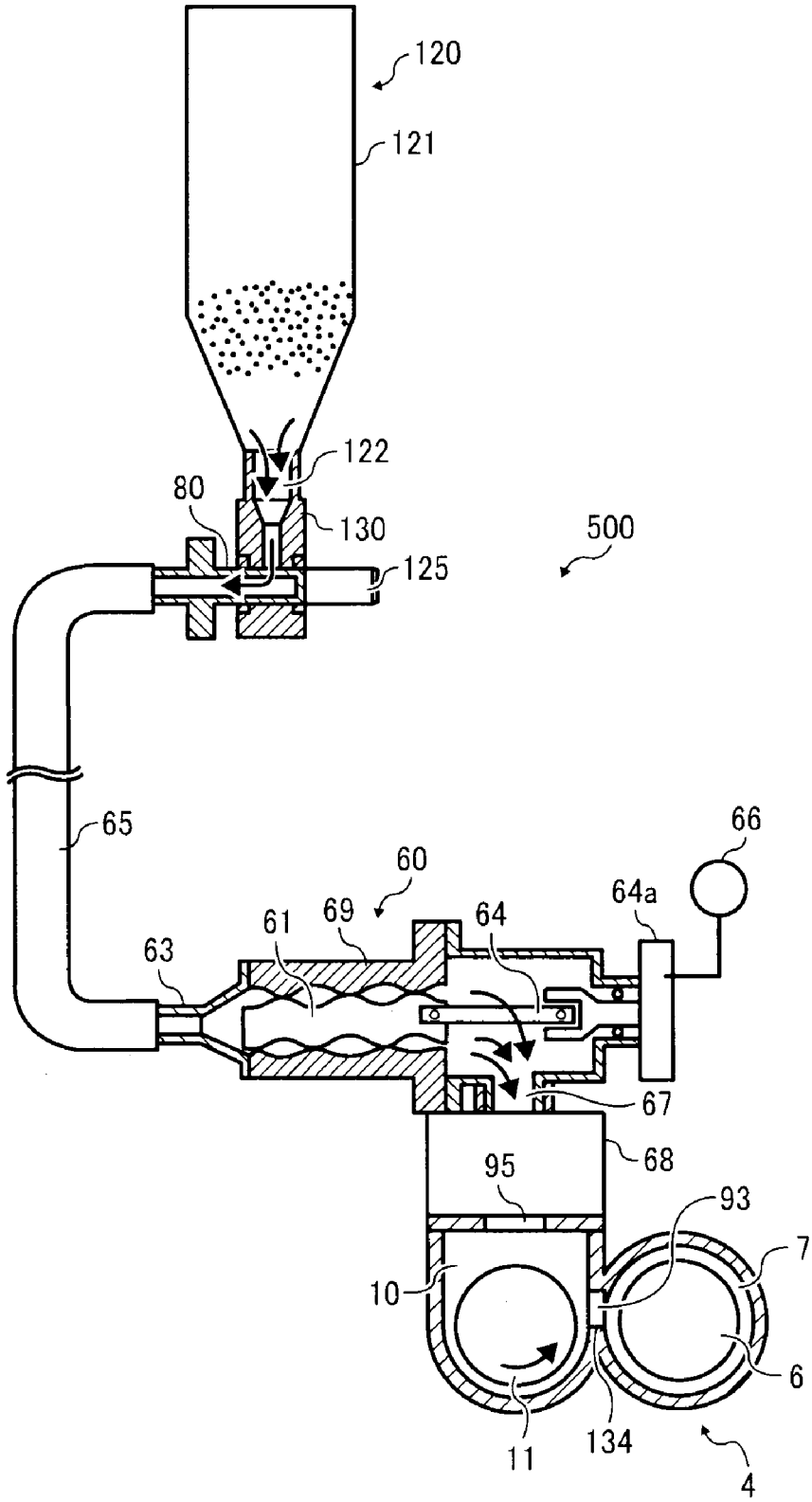
FIG. 6 is a schematic cross-sectional view illustrating the toner supplying device.
Figure 7:
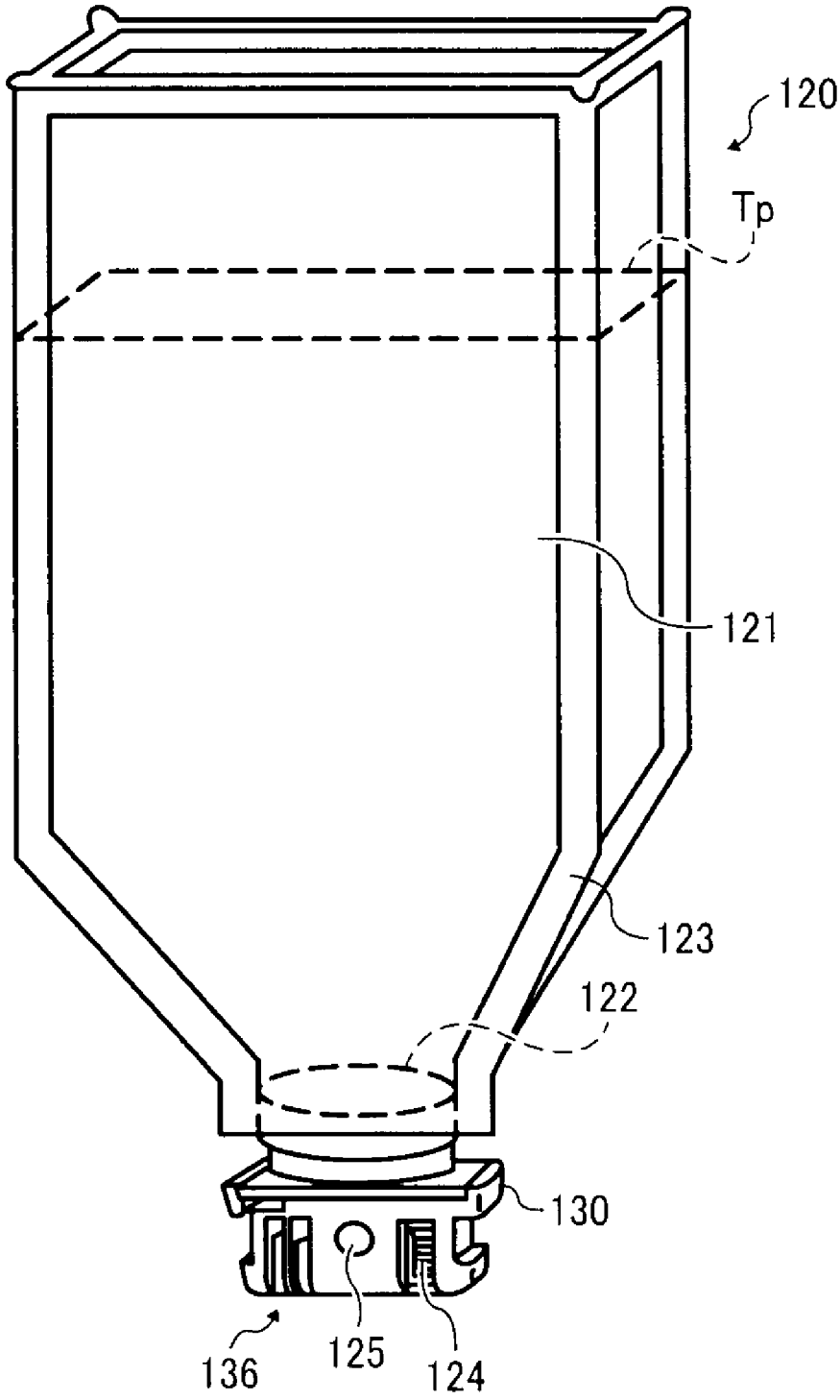
FIG. 7 is a schematic perspective view illustrating a toner container (toner bottle) of the toner supplying device.
Figure 8:
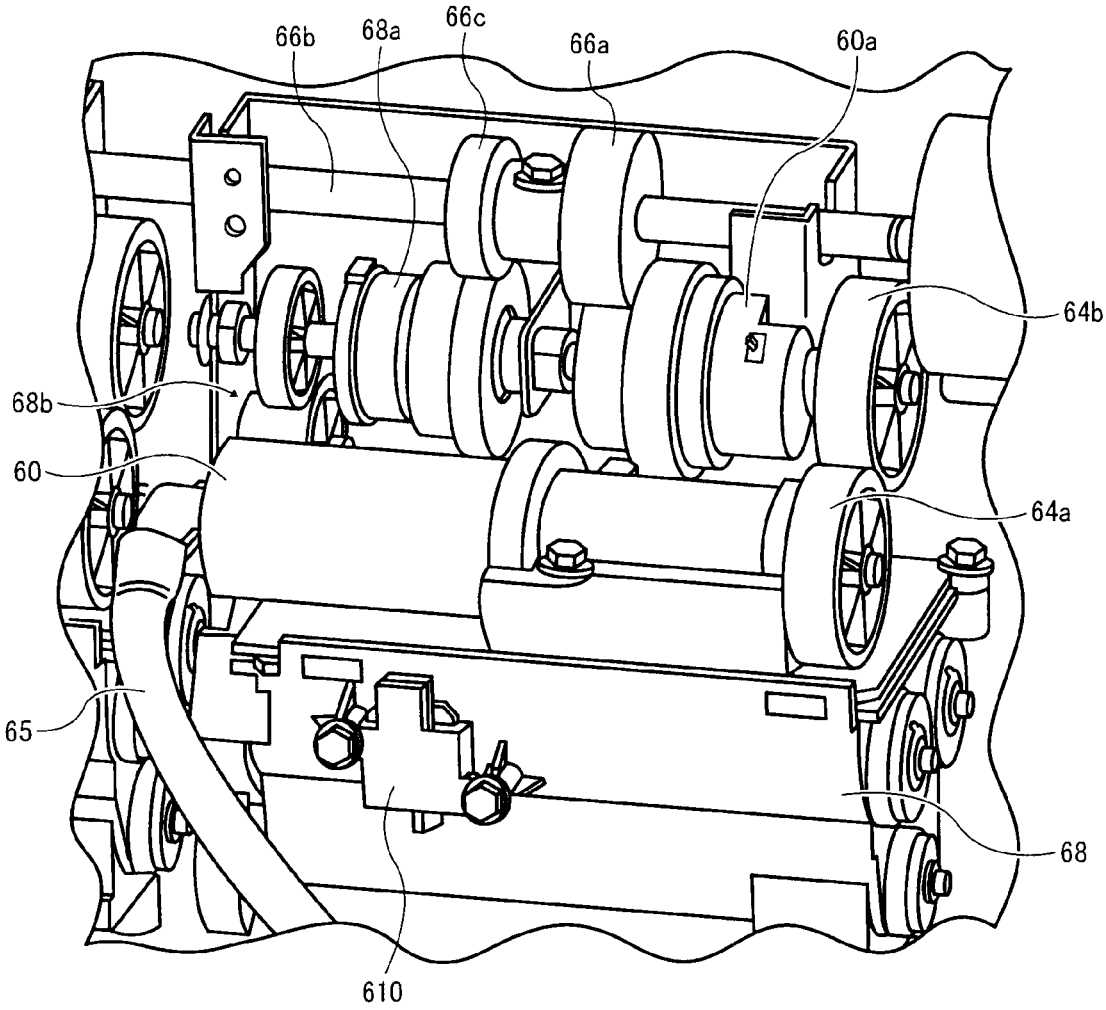
FIG. 8 is a schematic perspective view for explaining drive transmission between a toner pump and a sub-hopper in the toner supplying device.
Figure 9:
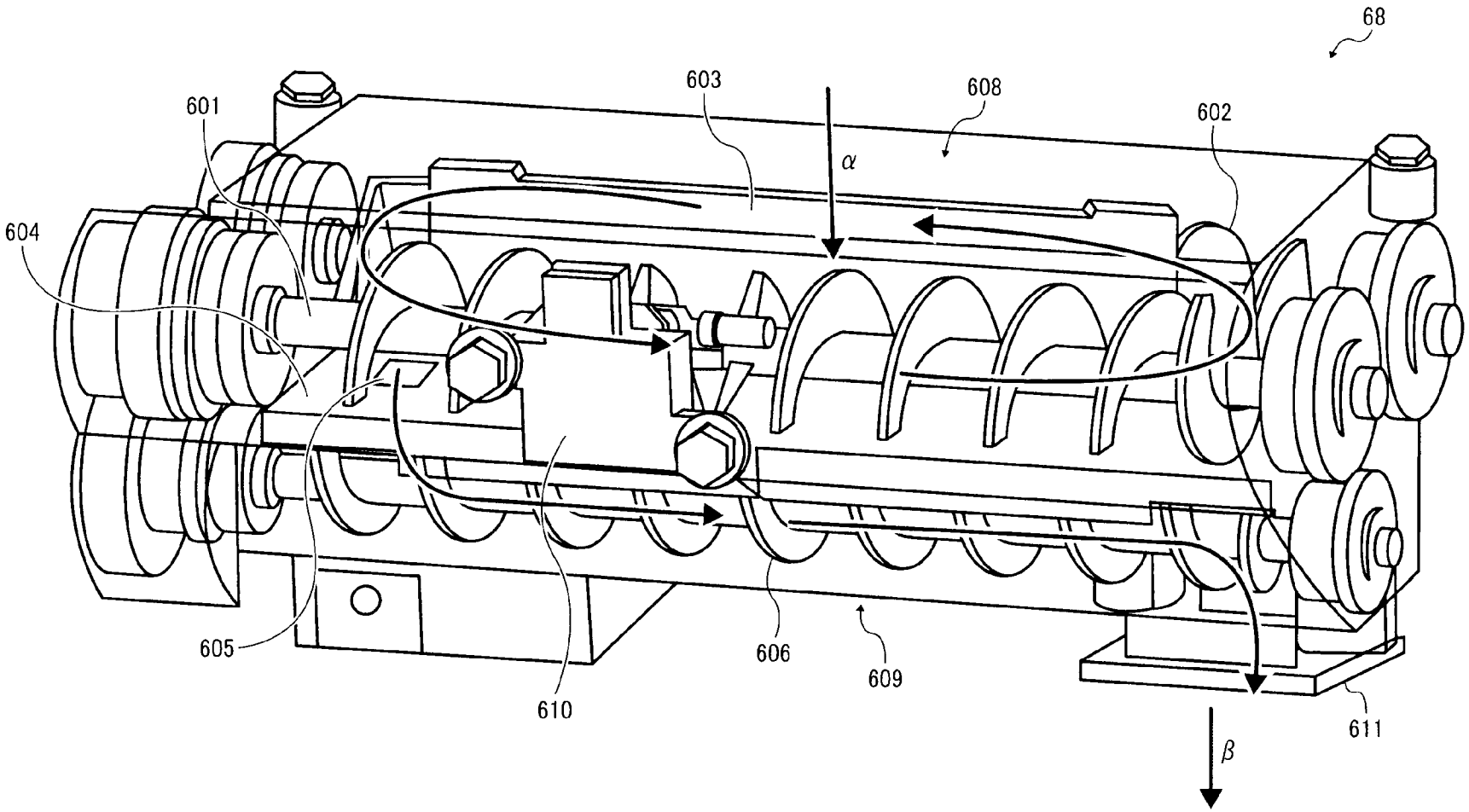
FIG. 9 is a schematic perspective view illustrating the sub-hopper.

FIG. 5 is a schematic perspective view illustrating a toner supplying device 500 of the copier 100. FIG. 6 is a cross-sectional view illustrating the toner supplying device 500. FIG. 7 is a schematic perspective view illustrating a toner bottle 120 serving as a developer container (or powder container). FIG. 8 is a schematic view illustrating a drive transmission portion of the toner supplying device 500 at which driving force is transmitted between a toner pump 60 and a sub-hopper 68. FIG. 9 is a schematic perspective view illustrating the sub-hopper.

The toner bottle 120 contains a premix toner, which is a mixture of a carrier and a toner, as the developer supplement, wherein the concentration of the toner in the premix toner is higher than that in the developer in the developing device 4. In FIG. 5, a character Tf denotes flow of the premix toner.

The copier 100, which is a tandem image forming apparatus, has a configuration such that plural toner bottles 120 containing respective premix color toners are arranged side by side as illustrated in FIG. 5. The toner bottles 120 are connected with respective supplying units each including the sub-hopper 68 and the toner pump 60 through respective toner supplying tubes 65. The developing devices 4 are connected with lower portions of the respective supplying units.

In this example, the toner pump 60 serving as a pumping device is a mohno pump which is a screw pump and which includes a stator 69 and a rotor 61 (illustrated in FIG. 6) configured to feed the premix toner in the axis direction thereof by rotating in the stator. The stator 69 is made of an elastic material and has a spiral groove on the inner surface thereof. For example, pumps described in JP-A 2000-98721 can be used for the toner pump 60.

As illustrated in FIGS. 6 and 7, the toner bottle 120 includes a toner containing portion 121 serving as a powder containing portion, a toner discharging opening 122 and a cap 130 attached to the toner discharging opening 122. The toner bottle 120 will be explained later in detail.

When the toner bottle 120 is set to the main body of the copier 100, the tip of a nozzle 80 serving as a connecting member is inserted into the cap 130, and thereby the toner discharging opening 122 is engaged with a toner receiving opening of the nozzle 80. The nozzle 80 has a joint connected with the toner supplying tube 65, the other end of which is connected with the toner pump 60. In addition, the toner pump 60 is connected with the developing device 4 through the sub-hopper 68. Thus, when the toner bottle 120 is set to the main body of the copier 100, the toner bottle 120 is connected with the developing device 4. Referring to FIG. 6, numeral 125 denotes a cylindrical shutter. In FIG. 6, the shutter 125 is pushed out by a nozzle provided on the main body of the image forming apparatus so that the premix toner in the toner bottle 120 is discharged.

The toner pump 60 is a suction-type uniaxial eccentric screw pump, and includes the rotor 61 and the stator 69 as mentioned above. The rotor 61 is a spirally-twisted shaft having a circle cross section, and is connected with a driving motor 66 via the drive transmission portion and a universal joint 64 as illustrated in FIG. 6. The stator 69 is made of an elastic material such as rubbers and has a twisted hole having an oval cross section. The pitch of the spiral groove formed on the inner surface of the stator 69 is twice the pitch of the spirally-twisted rotor 61 as illustrated in FIG. 6. By rotating the rotor 61 in the stator 69, the premix toner in the space formed between the rotor and the stator can be fed.

Namely, by rotating the rotor 61 without rotating the stator 69, the rotor is moved while rubbing the stator, resulting in formation of a negative pressure at a toner suction opening 63, thereby forming airflow in the toner supplying tube 65.

Thus, when the toner pump 60 is operated and the rotor 61 is rotated, the premix toner in the toner bottle 120 is fed to the toner pump 60 through the toner suction opening 63. The thus fed premix toner is then fed from the left side to the right side (in FIG. 6) by suction. The premix toner is then supplied to the developing device 4 through the toner supplying opening 95 via a toner discharging opening 67 and the sub-hopper 68.

In FIG. 6, drive transmission of from the driving motor 66 to the universal joint 64 is schematically illustrated. The drive transmission portion for transmitting the driving force of the driving motor 66 to the universal joint 64 will be explained in detail by reference to FIG. 8.

When the driving motor 66 illustrated in FIG. 8 rotates, a driving shaft **66*b* is rotated, and first and second shaft gears 66*a* and 66*c*, which are connected with the driving shaft 66*b*, are also rotated. When the first shaft gear 66*a* is rotated, the driving force is transmitted to a pump drive clutch 60*a*. A controller 600 (illustrated in FIG. 10), which is a control board present in the main body of the copier, performs controlling such that when the pump driving clutch 60*a* is turned on, the driving force is transmitted to a shaft drive gear 64*a* via a pump idler gear 64*b*, thereby rotating the rotor 61**.

On the other hand, when the second shaft gear **66*c* is rotated, driving force is transmitted to a sub-hopper drive clutch 68*a*. The controller 600 performs controlling such that when the sub-hopper drive clutch 68*a* is turned on, the driving force is transmitted to the sub-hopper 68 via an idler gear train 68*b***, thereby rotating screws of the sub-hopper (which are explained later).

Next, the sub-hopper 68 will be explained by reference to FIG. 9.

The sub-hopper 68 includes an upper casing 608 and a lower casing 609. The space formed by the upper and lower casings 608 and 609 is separated with a partition plate 604. A first upper screw 601 and a second upper screw 602 are located in the upper casing 608. In addition, an upper partition wall 603 having openings at both ends thereof is provided between the first and second upper screws 601 and 602.

A lower screw 606 is located in the lower casing 609, and the partition plate 604 has an opening 605 configured to connect the upper space of the sub-hopper 68 with the lower space of the sub-hopper 68.

Flow of the premix toner is shown by curved arrows in FIG. 9. The premix toner from the toner pump 60 is supplied to the sub-hopper 68 as illustrated by an arrow α. In addition, the premix toner is supplied from the sub-hopper 68 to the developing device 4 as illustrated by an arrow β.

When the driving force is input to the sub-hopper 68 via the idler gear train 68*b*, the first and second upper screws 601 and 602, and the lower screw 606 are rotated. In this case, the first and second upper screws 601 and 602 feed the premix toner in different directions, and therefore the premix toner is circulated in the upper casing 601 while agitated.

A joint opening 611 located on a lower portion of the sub-hopper case is connected with the toner supplying opening 95 (illustrated in FIG. 4) formed on the screw case located on the front end portion of the developing device 4. When the screws in the sub-hopper 68 are rotated, the premix toner is supplied from the sub-hopper to the developing device 4 through the joint opening 611.

A part of the premix toner agitated by the first and second upper screws 601 and 602 is supplied to one end of the lower casing 609 through the opening 605. The premix toner supplied to the lower casing 609 is fed to the joint opening 611 by rotation of the lower screw 606. Thus, the premix toner is supplied to the developing device 4.

In this regard, a vibration-type toner sensor 610 is provided in the vicinity of the first upper screw 601 in the upper casing 608 to determine whether the predetermined amount of premix toner is present in the sub-hopper 68 with the detection surface of the sensor, which is contacted with the premix toner in the upper casing 608.

FIG. 7 is a perspective view illustrating the toner bottle 120.

Referring to FIG. 7, the toner containing portion 121 of the toner bottle 120 containing a premix toner Tp is a bag (i.e., a soft package) prepared by welding a sheet of resin or the like. The sheet is typically prepared by laminating plural different resin films. Specifically, the sheet is typically formed of an inner layer made of a weldable material, an intermediate layer made of an airtight material, and an outer layer made of a rigid material.

Specific examples of the weldable materials for use in the inner layer include polyethylene resins and the like, which can be melted at a relatively low temperature. Specific examples of the airtight materials and rigid materials include polyethylene terephthalate resins (PET), nylon resins, aluminum sheets, paper sheets, etc. The materials used for these layers are determined depending on the material (i.e., solid, liquid, powder, etc.) to be contained therein, and the purpose of the bag (i.e., food-use, medical-use, etc.). In this example, the toner containing portion 121 is made of a polyethylene film serving as the inner layer, a nylon film serving as the intermediate layer, and a PET film serving as the outer layer.

The layers of the toner containing portion 121 will be explained in detail.

By using a material, which can be easily melted at a relatively low temperature, for the inner layer of the toner containing portion 121, the layer is evenly melted upon application of heat thereto and thereby both the ends of the sheet can be adhered with each other without a space therebetween The intermediate layer prevents the premix toner Tp from being exposed to ambient air when the toner bottle 120 is stored. When the premix toner is exposed to air, the premix toner is often deteriorated. For example, the premix toner often agglomerates particularly under high humidity conditions. In this case, the premix toner cannot be easily supplied to the developing device. In order to prevent occurrence of such a problem, the toner bottle has the intermediate layer formed of an airtight material.

In addition, the users directly contact the toner bottle, and therefore the toner bottle preferably has a good handling property. By using a rigid material for the outer layer while adjusting the thickness of the layer, a proper rigidity can be imparted to the toner bottle.

The sheet constituting the toner bottle can include one or more layers in addition to these three layers.

The toner containing portion 121 is prepared by folding a sheet in such a manner that the end portions of the inner layer are contacted with each other, and then the contacted end portions are heated. By performing this operation plural times on other end portions of the sheet, a bag for use as the toner containing portion 121 can be prepared.

The method for preparing the toner containing portion 121 is not limited thereto, and a method in which the end portions of the sheet are adhered to each other with an adhesive can also be used. For example, paper bags can be preferably prepared by this method. Since the ridge lines of a bag prepared by this method are formed by folding the sheet, the ridge lines have the same strength as that of the other portions of the bag.

In contrast, the bag prepared by the above-mentioned welding method has a welded portion 123 at the ridge lines thereof as illustrated in FIG. 7. Since the welded portion 123 includes two sheets, the thickness thereof is about twice the thickness of the other portion of the bag. Therefore, since the welded portion 123 serves as a pillar, the bag has a good rigidity. Such a rigid bag can prevent occurrence of problems in that the toner container is buckled or the portion of the toner bottle in the vicinity of the toner discharging opening 122 is deformed due to vibration in transportation and impact in handling, resulting in clogging of the toner bottle with the premix toner.

As mentioned above, the toner containing portion 121 is made of a sheet, and therefore the toner containing portion can be deformed. Therefore, even when the amount of the premix toner is changed or the properties (such as shapes) of the premix toner are changed, the toner containing portion can change its shape so as to fit the premix toner therein. In addition, after use the toner bottle can be collected by being rounded or folded. Thus, the toner bottle has good handling property.

Since it is difficult to fix the deformable toner containing portion 121 to the toner supplying device 500, the toner containing portion 121 is set to the cap 130 made of a hard resin, etc. Since the cap is engageable with the toner supplying device 500, the toner bottle can be securely set to the toner supplying device 500. The cap 130 is made of a molded resin having high rigidity. By preparing the inner layer of the toner containing portion 121 and the cap 130 using polyethylene, the cap can be easily attached to the toner containing portion 121 without a space therebetween by a welding method. Specifically, at first a part of the cap 130 is inserted into the toner containing portion 121, and then the connected portion is heated with a welding device. By using this method, the cap 130 can be securely fixed to the toner containing portion 121.

The cap 130 has an attaching part 136 to be engaged with the main body of the copier 100. The forms of the attaching parts 136 of the toner bottles 120 for yellow, magenta, cyan and black toners are different from each other. Therefore, occurrence of a problem in that a toner bottle 120 is set to a wrong position can be prevented. In addition, a RF tag 124 is attached to one side of the cap 130. The RF tag 124 is an information recording medium in which data stored in the memory thereof are read or rewritten in a noncontact manner using an electric wave (electromagnetic wave). The RF tag stores information such as names of the image forming apparatus for which the premix toner contained in the toner bottle can be used, color of the premix toner, manufacturing date of the premix toner, and amount of residual premix toner in the toner bottle.

Next, the way to replace the developer in the developing device 4 will be explained by reference to FIGS. 2 and 3.

The toner supplying device 500 supplies the premix toner, which includes a carrier and a toner and which is contained in the toner bottle 120, to the developing device 4 through the toner supplying opening 95.

The developing device 4 includes a developer discharging opening 94 from which a part of the developer is discharged when the volume of the developer in the developer supplying passage 9 exceeds a predetermined volume, and a developer discharge passage 2 configured to discharge the excess developer from the developing device 4. As illustrated in FIG. 3, the developer discharge passage 2 is located on the downstream side of the developer supplying passage 9 relative to the developer feeding direction while separated from the developer supplying passage 9 with a partition 135. The developer discharging opening 94 is formed on the partition 135 so that the developer supplying passage 94 is engaged with the developer discharging passage 2.

In the developing device 4, the developer stays in the vicinity of the downstream side of the developer supplying passage 9 (this portion is hereinafter sometimes referred to as a developer staying position) depending on the amount of the developer fed through the developer supplying passage 9, the amount of the developer (excess developer) supplied to the developing roller 5, and the amount of the developer moving from the developer supplying passage 9 to the developer agitating passage 10 through the opening 92. When the amount of the developer in the developing device 4 is constant, the amount (per unit time) of the developer fed to the downstream side of the developer supplying passage 9 is almost equal to the amount (per unit time) of the developer moving from the developer supplying passage 9 to the developer agitating passage 10 through the opening 92. Therefore, the volume of the developer staying in the vicinity of the downstream side of the developer supplying passage 9 is constant in this case.

However, when the amount of the developer in the developing device 4 increases, the amount of the developer fed to the downstream side of the developer supplying passage 9 becomes greater than the amount of the developer moving from the developer supplying passage 9 to the developer agitating passage 10 through the opening 92. Therefore, the volume of the developer present at the developer staying position increases.

The developer discharging opening 94 is arranged at the developer staying position. When the developer staying at the developer staying position increases and exceeds the upper end of the developer discharging opening 94, the excess developer is discharged from the developer supplying passage 9 to the developer discharging passage 2.

When the premix toner is not supplied from the toner supplying device 500 to the developing device 4, the amount of the developer in the developing device hardly changes, and therefore the amount of the developer staying at the developer staying position hardly changes. In contrast, when the premix toner is supplied from the toner supplying device 500 to the developing device 4, the amount of the developer in the developing device increases, and therefore the amount of the developer staying at the developer staying position increases. In this case, when the developer staying at the developer staying position reaches the developer discharging opening 94, the excess developer is discharged from the developer supplying passage 9 to the developer discharging passage 2 through the opening 94. The excess developer is then discharged from the developing device. Referring to FIG. 2, numeral 2*a* denotes a discharging screw for discharging the excess developer from the developing device, which is provided in the discharging passage 2.

In this regard, the developer discharged from the developing device 4 includes the carrier and the toner while the premix toner supplied to the developer includes a fresh developer and a fresh toner. Therefore, partial replacement of the developer in the developing device is performed.

In conventional image forming apparatus having a developing device using a two-component developer including a carrier and a toner, it is typical to supply only the toner to the developing device in an amount equal to the amount of the toner used for developing images. Such image forming apparatus have a drawback in that the developer in the developing device deteriorates after repeated use, resulting in occurrence of problems in that the image qualities deteriorate and the toner scatters around the developing device. Therefore, it is necessary for a service person to frequently perform a maintenance operation in which the developer in the developing device is replaced with a fresh developer.

In contrast, a premix toner including a carrier and a toner is supplied to the developing device 4 in the copier 100 of the present invention, and therefore the developer can be replaced with a fresh developer while image forming operations are performed. Therefore, the life of the developer is prolonged, and thereby the interval between maintenance operations is extended, resulting in decrease of the down time of the image forming apparatus.

The toner used for the premix toner contained in the toner bottle 120 is preferably a toner prepared by a method including dissolving or dispersing toner components including at least a polyester prepolymer having a group including a nitrogen atom, a polyester, a colorant and a release agent in an organic solvent to prepare a toner composition liquid, and subjecting the toner composition liquid to a crosslinking reaction and/or a polymer chain growth reaction in an aqueous medium. This toner has good low temperature fixability. By using such a toner, the fixing temperature of the fixing device 25 can be decreased, resulting in decrease of the energy consumption of the fixing device 25 and the copier 100.

Next, the toner components and the toner preparation method will be explained.

(Polyester)

Polyesters for use in the toner for use in the image forming apparatus of the present invention is prepared by subjecting a polyol with a polycarboxylic acid to a polycondensation reaction.

Suitable polyols (PO) for use in preparing the polyesters include diols (DIO), polyols (TO) having three or more hydroxyl groups, and mixtures of DIO and TO. Preferably, diols (DIO) alone or mixtures of a diol (DIO) and a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the polyesters include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (PO), anhydrides or lower alkyl esters (e.g., methyl esters, ethyl esters or isopropyl esters) of the polycarboxylic acids mentioned above can also be used as the polycarboxylic acid (PC).

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

The polycondensation reaction of a polol with a polycarboxylic acid is performed by heating the compounds to a temperature of from 150 to 280° C. in the presence of an esterification catalyst such as tetrabutoxytitanate and dibutyl tin oxide while removing generated water (under a reduced pressure if necessary) to prepare a polyester having a hydroxyl group. The hydroxyl value of the polyester is preferably not less than 5 mgKOH/g, and the acid value thereof is preferably from 1 to 30 mgKOH/g, and more preferably from 5 to 20 mgKOH/g. When a polyester having a proper acid value is used, a negative charging property can be imparted to the resultant toner. In addition, the adhesion of the toner to receiving papers can be improved, resulting in improvement of low temperature fixability of the toner. However, when the acid value is too high, the charging stability of the toner deteriorates (particularly the charging property of the toner varies when environmental conditions (such as humidity) change).

The weight average molecular weight of the polyester to be included in the toner for use in the present invention is preferably from 10,000 to 400,000, and more preferably from 20,000 to 200,000. When the weight average molecular weight is too low, the offset resistance of the toner deteriorates. In contrast, when the weight average molecular weight is too high, the low temperature fixability of the toner deteriorates.

The polyesters prepared by the above-mentioned polycondensation reaction are unmodified polyesters. In addition to the unmodified polyesters, urea-modified polyesters can be used for the toner. Such a urea-modified polyester is prepared by reacting a carboxyl group or a hydroxyl group present at the end portions of the unmodified polyester with a polyisocyanate compound (PIC) to prepare a polyester prepolymer having an isocyanate group, and then reacting the polyester prepolymer with an amine to perform a crosslinking reaction and/or a polymer chain growth reaction.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the urea-modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester for use as a binder resin of the toner for use in the present invention can be prepared by reacting a polyester prepolymer (A) having an isocyanate group with an amine (B).

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The urea-modified polyesters for use in the toner can include a urethane bond as well as a urea bond. The molar ratio of the urea bond to the urethane bond is from 100/0 to 10/90, preferably from 80/20 to 20/80, and more preferably from 60/40 to 30/70. When the molar ratio of the urea bond is too low, the hot offset resistance of the resultant toner deteriorates.

The urea-modified polyesters can be prepared, for example, by a method such as one-shot methods. Specifically, the polycondensation reaction of a polyhydric alcohol with a polycarboxylic acid is performed by heating the compounds to a temperature of from 150 to 280° C. in the presence of an esterification catalyst such as tetrabutoxytitanate and dibutyl tin oxide while removing generated water (under a reduced pressure if necessary) to prepare a polyester resin having a hydroxyl group. Then the polyester resin is reacted with a polyisocyanate (PIC) at a temperature of from 40 to 140° C. to prepare a polyester prepolymer (A) having an isocyanate group. Further, the polyester prepolymer (A) is reacted with an amine (B) at a temperature of from 0 to 140° C. to prepare a urea-modified polyester.

When a polyester prepolymer (A) is reacted with an amine (B), solvents can be used if necessary. Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetamide; ethers such as tetrahydrofuran. In this regard, solvents inactive with the isocyanate used are preferably used.

The molecular weight of the urea-modified polyesters can be controlled using a reaction inhibitor, if desired. Specific examples of such a reaction inhibitor include monoamines (e.g., diethyle amine, dibutyl amine, butyl amine and lauryl amine), and blocked amines (i.e., ketimine compounds) prepared by blocking the monoamines mentioned above.

The weight average molecular weight of the urea-modified polyester for use in the toner is generally not less than 10,000, preferably from 20,000 to 10,000,000 and more preferably from 30,000 to 1,000,000. When the weight average molecular weight is too low, the hot offset resistance of the resultant toner deteriorates. The number average molecular weight of the urea-modified polyester is not particularly limited (i.e., the weight average molecular weight of the urea-modified polyester is controlled so as to fall the above-mentioned range) when an unmodified polyester resin is used in combination therewith. When a urea-modified polyester is used alone, the number average molecular weight thereof is from 2,000 to 15,000, preferably from 2,000 to 10,000 and more preferably from 2,000 to 8,000. When the molecular weight is too high, the low temperature fixability of the resultant toner deteriorates and the glossiness of color toner images decreases.

In the present invention, it is preferable to use a combination of a urea-modified polyester with an unmodified polyester as the binder resin of the toner. By using such a combination, the low temperature fixability of the toner can be improved and in addition the toner can produce color images having a high glossiness. In this regard, polyester resins modified by a bond (such as urethane bonding) other than a urea bond are considered as the unmodified polyester in the present application.

When a combination of a urea-modified polyester with an unmodified polyester resin is used as the binder resin, it is preferable that the urea-modified polyester is at least partially mixed with the unmodified polyester resin to improve the low temperature fixability and hot offset resistance of the toner. Namely, it is preferable that the urea-modified polyester has a molecular structure similar to that of the unmodified polyester resin. The mixing ratio (U/M) of an unmodified polyester (U) to a urea-modified polyester (M) is from 20/80 to 95/5, preferably from 70/30 to 95/5, more preferably from 75/25 to 95/5, and even more preferably from 80/20 to 93/7. When the added amount of the modified polyester resin is too small, the hot offset resistance of the toner deteriorates and in addition, it is impossible for the toner to achieve a good combination of high temperature preservability and low temperature fixability.

The binder resin including an unmodified polyester resin and a urea-modified polyester resin preferably has a glass transition temperature (Tg) of from 45 to 65° C., and preferably from 45 to 60° C. When the glass transition temperature is too low, the heat resistance of the toner deteriorates. In contrast, when the glass transition temperature is too high, the low temperature fixability of the toner deteriorates.

Since a urea-modified polyester resin tends to be located on the surface of toner particles, the toner has a relatively good high temperature preservability compared with conventional toners including a polyester even when the toner has a relatively low glass transition temperature compared with the conventional toners.

(Colorant)

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene or styrene derivatives with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

(Charge Controlling Agent)

The toner for use in the image forming apparatus of the present invention preferably includes a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89. (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

Among these materials, materials capable of imparting a negative polarity to the toner are preferably used.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

(Release Agent)

The toner for use in the image forming apparatus of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymers and copolymers having a long alkyl group in their side chain, e.g., poly-n-stearyl methacrylate, poly-n-laurylmethacrylate and n-stearyl acrylate-ethyl methacrylate copolymers, can also be used.

The above-mentioned charge controlling agent and release agent can be kneaded with a master batch and a binder resin. Alternatively, the charge controlling agent and the release agent can be added to an organic solvent when the toner composition liquid is prepared.

(External Additive)

A particulate inorganic material is typically mixed with toner particles to assist in improving the fluidity, developing property and charging ability of the toner particles. It is preferable for such particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on the total weight of the toner.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a combination of a hydrophobic silica with a hydrophobic titanium oxide each having an average particle diameter not greater than 50 nm is used as an external additive, the electrostatic force and van der Waals' force between the external additive and the toner particles can be improved, and thereby the resultant toner has a proper charge quantity. In addition, even when the toner is agitated in a developing device, the external additive is hardly released from the toner particles, and thereby image defects such as white spots and image omissions are hardly produced. Further, the quantity of particles of the toner remaining on image bearing members can be reduced.

Titanium oxide exhibits high stability to withstand environmental conditions, and stably produce high density images. However, titanium oxide has a drawback in that the charge rising property of the toner deteriorates. Therefore it is not preferable that the content of titanium oxide is higher than that of silica. When the content of a hydrophobized titanium oxide is from 0.3 to 1.5% by weight, the charge rising property of the resultant toner hardly deteriorates. Therefore, images having good image qualities can be stably produced even when images are repeatedly produced.

Next, the method for preparing the toner for use in the present invention will be explained.

(1) Preparation of Toner Composition Liquid

At first, a toner composition liquid is prepared by dissolving or dispersing toner components such as a colorant, an unmodified polyester, a polyester prepolymer having an isocyanate group and a release agent in an organic solvent. The organic solvent is preferably a volatile solvent having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the polyester prepolymer is generally from 0/100 to 300/100, preferably from 0/100 to 100/100 and more preferably from 25/100 to 70/100.

(2) Emulsification of the Toner Composition Liquid

The toner composition liquid is then dispersed in an aqueous medium in the presence of a surfactant and a particulate resin to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio of the aqueous medium to the toner composition liquid is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified, a dispersant such as surfactants and particulate resins are preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl (C7-C13) carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-10, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNI- DYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Particulate resins are added to the aqueous medium to stabilize the toner particles, which are prepared in the aqueous medium. It is preferable that the added particulate resin covers the surface of toner particles at a covering ratio of from 10 to 90%. Specific examples of the particulate resins include particulate polymethyl methacrylates (having a particle diameter of about 1 μm or 3 μm), particulate polystyrenes (having a particle diameter of about 0.5 μm or 2 μm), and particulate styrene-acrylonitrile copolymers (having a particle diameter of about 1 μm). Specific examples of the marketed products of the particulate resins include PB-200H (from Kao Corp.), SGP (from Sohken Chemical & Engineering Co., Ltd.), TECHNOPOLYMER SB (from Sekisui Plastics Co., Ltd.), SGP-3G (from Sohken Chemical & Engineering Co., Ltd.), MICROPEARL (Sekisui Chemical Co., Ltd.), etc.

In addition, inorganic compounds can be used as a dispersant. Specific examples of the inorganic compounds include tricalcium phosphate, calcium carbonate, titanium oxide, colloidal silica, and hydroxyapatite can be preferably used.

Further, it is preferable to stabilize the emulsion or dispersion using a polymer protection colloid in combination with the particulate resins and/or inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

(3) Reaction of Polyester Prepolymer (A) with Amine (B)

At the same time when preparing the emulsion, the polyester prepolymer (A) having an isocyanate group is reacted with an amine (B). The reaction is accompanied with crosslinking and/or polymer chain growth of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and tioctyltin layrate can be used for the reaction, if desired.

(4) Removal of Organic Solvent, and Washing and Drying

After the reaction, the organic solvent is removed from the emulsion (i.e., the reaction product), followed by washing and drying. Thus, toner particles having a spindle form are prepared. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant (such as calcium phosphate), which can be dissolved in an acid or an alkali, is used, it is preferable to dissolve the dispersant with hydrochloric acid to remove that from the toner particles, followed by washing. In addition, it is possible to remove such a dispersant by decomposing the dispersant using an enzyme.

(5) Addition of External Additive

Next, a charge controlling agent is fixed on the thus prepared toner particles and an external additive such as particulate inorganic materials (e.g., silica and titanium oxide) is added thereto. If desired, a particulate lubricant can also be added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled, specifically, the surface can be freely changed from smooth surface to rough surface like pickled plum.

Next, drive controlling of the toner pump 60 and the sub-hopper 68 will be explained.

Figure 10:
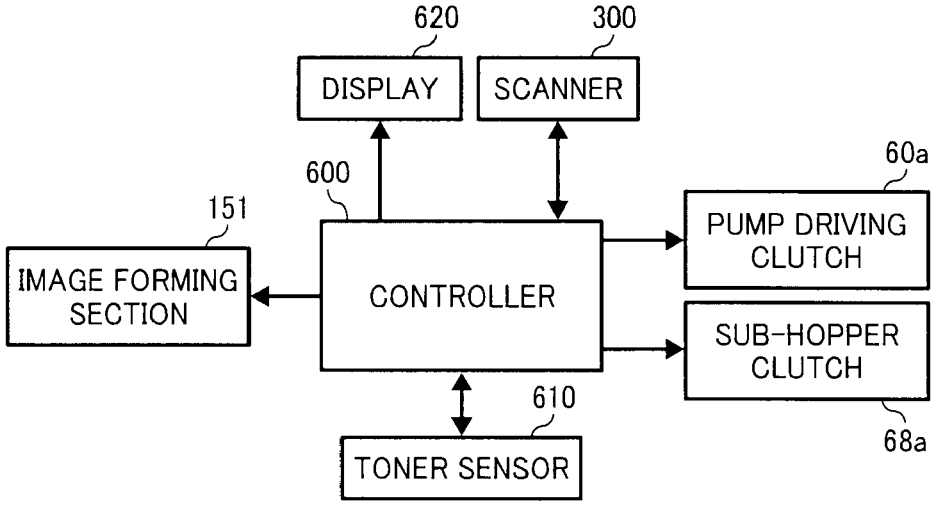
FIG. 10 is a block diagram for explaining drive controlling of the toner pump and the sub-hopper.

FIG. 10 is a block diagram for explaining drive controlling of the toner pump 60 and the sub-hopper 68.

As illustrated in FIG. 10, the controller 600 controls an image forming section 151 including the optical writing unit 21, the photoreceptor 1, a charger, the developing device 4, a drum cleaner, and a discharger, according to the image information obtained by the scanner 300 to perform image forming operations. The controller 600 activates the sub-hopper drive clutch 68*a* to drive the sub-hopper 68 after every image forming operation of the image forming section 151. In this regard, the controller 600 controls the sub-hopper drive clutch 68*a* such that the greater image area proportion the recorded image has, the longer the ON time of the sub-hopper drive clutch 68*a*. By performing such a controlling operation, the volume of the developer present in the developing device can be controlled to fall in a predetermined range.

The controller 600 performs toner detection at a predetermined interval (2 seconds in this example) using the toner sensor 610. When the toner sensor 610 determines that the amount of toner at the position of the toner sensor is less than a predetermined amount, the controller 600 activates the pump drive clutch 60*a*, thereby driving the toner pump 60 to supply the premix toner to the sub-hopper 68. In this case, the pump drive clutch 60*a* is turned off at the next toner detection time (i.e., 2 seconds after the last toner detection) while the toner sensor 610 determines whether or not the amount of toner is less than the predetermined amount. When the toner sensor 610 determines that the amount of toner is still less than the predetermined amount, the controller 600 activates the pump drive clutch 60*a* to drive the pump 60. This controlling such that the pump drive clutch 60*a* is activated for a predetermined time, followed by inactivating is repeated until the amount of toner becomes not less than the predetermined amount.

In contrast, when the toner sensor 610 determines that the amount of toner at the position of the toner sensor is not less than the predetermined amount, the toner detection operation is performed at regular intervals (i.e., 2 seconds) while turning off the pump drive clutch 60*a*.

When the toner sensor 610 continues to determine that the amount of toner is less than the predetermined amount even after the controlling that the pump drive clutch 60*a* is activated for a predetermined time, followed by inactivating is repeated, the controller 600 determines that the toner bottle 120 is in the near-empty state.

Specifically, the copier 100 determines the amount of the toner remaining in the toner bottle 120 by measuring a property influenced by the amount of toner supplied by the toner pump 60. In this example, the property is the amount of the toner present in the sub-hopper 68. Namely, if the toner sensor 610 does not determine that the amount of toner is not less than the predetermined amount even after the controlling that the pump drive clutch 60*a* is activated and then inactivated is repeated, the controller 600 determines that the toner bottle 120 is in the near-empty state. Thus, the toner sensor 610 and the controller 600 constitute the residual toner detector.

When it is determined that the toner bottle 120 is in the near-empty state, a near-empty message is displayed in a display 620 to notify the user that the premix toner is exhausted.

In this example, if the toner sensor 610 continues to determine that the amount of toner is less than the predetermined amount even after the controlling that the pump drive clutch 60*a* is activated and then inactivated is repeated ten times, the controller 600 determines that the toner bottle 120 is in the near-empty state (i.e., the premix toner is exhausted).

When the near-empty message is displayed in the display 620, the user replaces the toner bottle 120 with a new toner bottle. When the new toner bottle is set, the controller 600 turns on the pump drive clutch 60*a* to drive the toner pump 60, thereby supplying the premix toner in the new toner bottle 120 to the sub-hopper 68. When the toner sensor 610 determines that the amount of toner in the sub-hopper 68 is not less than the predetermined amount, the toner bottle replacing operation is completed and the pump drive clutch 60*a* is inactivated.

Next, the drive controlling of the screw pump in an image forming apparatus having a background screw pump will be explained.

Figure 11:
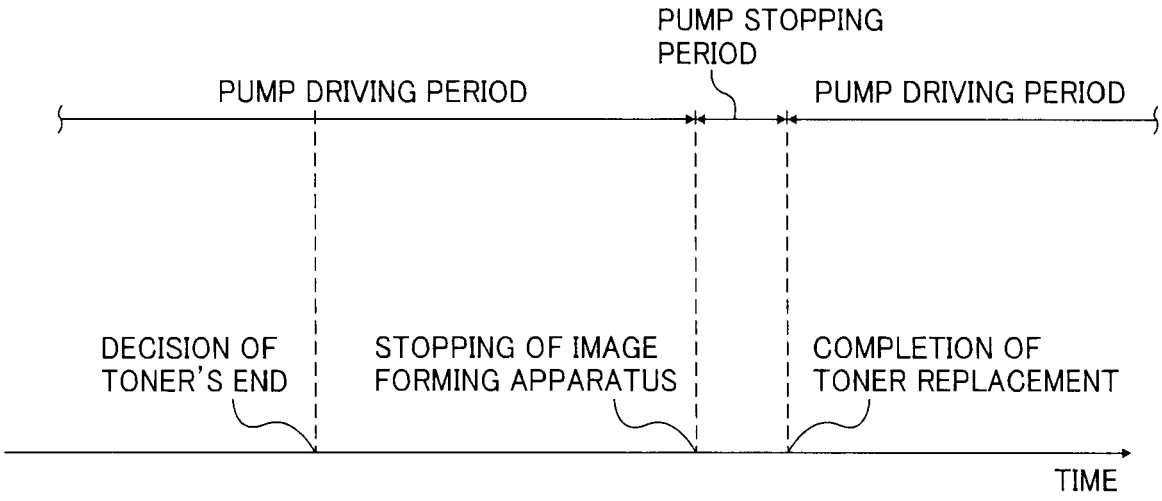
FIG. 11 BACKGROUND ART
FIG. 11 is a timing chart for explaining drive controlling of a screw pump in a background image forming apparatus.

FIG. 11 is a timing chart for explaining drive controlling of a screw pump in a background image forming apparatus. As illustrated in FIG. 11, even after the controller decides that the toner is ended, the background image forming apparatus continues to perform image forming operations until the predetermined conditions (such as printing of a predetermined amount of copies and elapse of a predetermined time) are satisfied. In addition, the screw pump in the background image forming apparatus continues to perform the normal driving operation until the image forming operation is stopped.

In this regard, the normal driving operation of the screw pump means the operation of the screw pump performed when a sufficient amount of premix toner is contained in the toner container. In the normal driving operation of the image forming apparatus of the present invention, the screw pump is activated for a predetermined time (2 seconds), and then inactivated for a predetermined time (0.2 seconds) while the toner detection operation is performed. In this regard, when it is determined that a predetermined amount of toner is not present, the screw pump is activated again for the predetermined time (2 seconds). In general, when a toner end decision is made, the detection result such that the sufficient amount of toner is not present is continuously produced. Therefore, in background image forming apparatus, activation and inactivation of the toner pump are repeatedly performed around the toner end decision, i.e., the toner pump is intermittently activated.

In general image forming apparatus, even after the toner supply by the screw pump is stopped, the toner (or premix toner) is present in the sub-hopper. Therefore, by supplying the toner in the sub-hopper to the developing device, the amount of the developer in the developing device and the concentration of toner in the developer can be maintained and thereby the image forming operations can be performed.

When the amount of the toner contained in the toner bottle becomes less than a certain amount, the amount of the toner fed by the screw pump varies. Therefore, even when the screw pump is driven, the amount of toner in the sub-hopper cannot be increased to the predetermined amount and the toner end decision is made. Thus, when the toner end decision is made, a small amount of toner remains in the toner bottle. Therefore, in conventional image forming apparatus, the normal operation of the screw pump is performed even after the toner end decision is made, to reduce the amount of the toner contained in the toner bottle.

Screw pumps generate a suction force while the rotor rubs the stator, thereby generating frictional heat in the pumps. When a sufficient amount of toner is present in the toner bottle, a certain amount of toner enters into the screw pump through the suction opening and then discharged from the discharge opening. In this case, the frictional heat is transferred to the toner fed through the screw pump and is then discharged from the pump together with the toner, thereby preventing increase of the internal temperature of the screw pump. However, when the amount of toner remaining in the toner bottle is small, the amount of toner entering into the pump decreases even when the screw pump is operated normally. Therefore, the quantity of frictional heat discharged from the pump together with the toner decreases. In this case, when the toner pump is normally operated, the internal temperature of the screw pump increases.

When controlling such that even when a toner end decision is made, the screw pump is driven to operate is performed, the toner end decision is continuously made when the amount of toner in the toner bottle is small. When a sufficient amount of toner is present in the toner bottle, the toner sensor makes a decision such that the toner is present in a predetermined amount after the screw pump is operated. In this case, the screw pump is stopped, and thereby the screw pump is cooled. In contrast, when a sufficient amount of toner is not present in the toner bottle, the toner end decision is continuously made and therefore the screw pump is operated without pause, resulting in increase of the internal temperature of the screw pump.

In this case, when a low temperature fixable toner is used for the image forming apparatus, the toner heated at a high temperature in the screw pump aggregates after being cooled. Thereby, the stator is further abraded by the aggregated toner, resulting in deterioration of suction power of the screw pump. Although low temperature fixable toner can be fixed at a relatively low fixing temperature, such toner is typically inferior to conventional toners in heat resistance and therefore the toner deteriorates at a relatively low temperature.

In the copier 100 of the present invention, when a toner end decision is made, the degree of increase of the internal temperature of the screw pump is reduced by reducing the operation time of the toner pump 60, stopping the operation of the toner pump, or decreasing the revolution of the toner pump. By using this method, the problem in that the suction power of the toner pump deteriorates can be avoided.

Having generally described this invention, further understanding can be obtained by reference to certain specific examples which are provided herein for the purpose of illustration only and are not intended to be limiting.

EXAMPLES

Example 1

One method for controlling increase of the internal temperature of a screw pump will be explained by reference to drawing.

Figure 12:
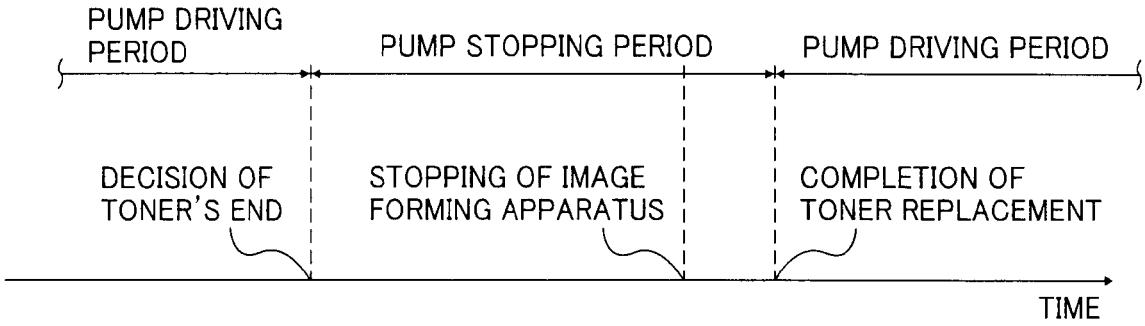
FIG. 12 is a timing chart for explaining drive controlling of a toner pump used for Example 1 of the image forming apparatus of the present invention.

FIG. 12 is a timing chart for explaining drive controlling of the toner pump 60 of the toner supplying device 500 of the copier 100 in this example.

In this example, when the controller 600 judges that the toner bottle 120 achieves a near-empty state (hereinafter sometimes referred to as a toner end decision) on the basis of the signal sent from the toner sensor 610 provided on the sub-hopper 68, the copier notifies the user by displaying a toner end message. After the toner end decision is made, the copier 100 continues the image forming operations for a while using the toner remaining in the sub-hopper 68. In this example, the copier produces 400 images after the toner end decision is made, and then stops the image forming operation. As illustrated in FIG. 12, after the toner end decision, the operation of the toner pump 60 is stopped. Namely, the toner pump 60 is stopped before the copier 100 is stopped.

The time when the operation of the toner pump 60 is stopped is determined depending on the properties (typically, heat resistance) of the toner used. If the toner has low heat resistance, it is preferable to stop the toner pump soon after the toner end decision. In this example, as illustrated in FIG. 12, the toner pump is stopped soon after the toner end decision.

By stopping the toner pump soon after the toner end decision, the degree of increase in the internal temperature of the toner pump 60 can be reduced. Thereby, melting of the toner in the toner pump 60 can be prevented, resulting in prevention of the problem in that the suction power of the toner pump is deteriorated due to abrasion of the stator 69 caused by the toner aggregated in the pump.

When a toner, which is not a low temperature fixable toner and has relatively good heat resistance, is used, the toner pump is preferably operated as long as possible to reduce the amount of toner remaining in the toner bottle.

Example 2

Another method for controlling increase of the internal temperature of a screw pump will be explained by reference to drawing.

Figure 13:
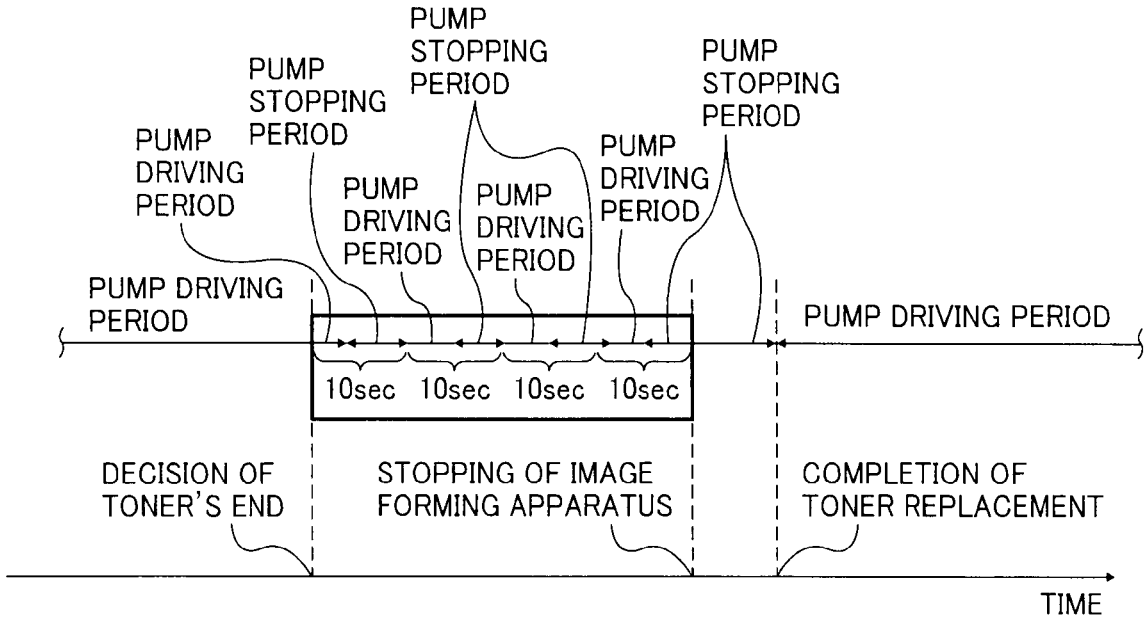
FIG. 13 is a timing chart for explaining drive controlling of a toner pump used for Example 2 of the image forming apparatus of the present invention.

FIG. 13 is another timing chart for explaining drive controlling of the toner pump 60 of the toner supplying device 500 of the copier 100 in this example.

In this example, when the controller 600 makes a toner end decision on the basis of the signal sent from the toner sensor 610 provided on the sub-hopper 68, the copier notifies the user by displaying a toner end message. After the toner end decision is made, the copier 100 continues the image forming operations for a while using the toner remaining in the sub-hopper 68. In this example, the copier produces 400 images after the toner end decision is made, and then stops the image forming operation.

As illustrated in FIG. 13, after the toner end decision, the number of driving of the toner pump per unit time is controlled to fall in a predetermined range. In this example, the toner pump 60 is operated not more than once per 10 seconds as illustrated in FIG. 13. Specifically, in this example, the toner pump 60 is operated for 2 seconds and then stopped for 8 seconds. Thus, the toner pump 60 is operated under a restricted condition. After the toner pump 60 is operated for a while under a restricted condition, the toner pump 60 is stopped before or at the same time the copier is stopped.

In this example, the ratio (S/D) of the stopping period (S) of the toner pump 60 to the driving period (D) thereof is relatively increased after the toner end decision compared to the ration (S/D) in the normal operation of the toner pump 60 performed before the toner end decision. By using this method, occurrence of the problem in that the internal temperature of the toner pump 60 increases, resulting in aggregation of the toner therein, thereby seriously abrading the stator 69 can be prevented.

The restricted condition for the operation of the toner pump is determined depending on the properties (typically, heat resistance) of the toner used.

Example 3

Another method for controlling increase of the internal temperature of a screw pump will be explained by reference to drawing.

Figure 14:
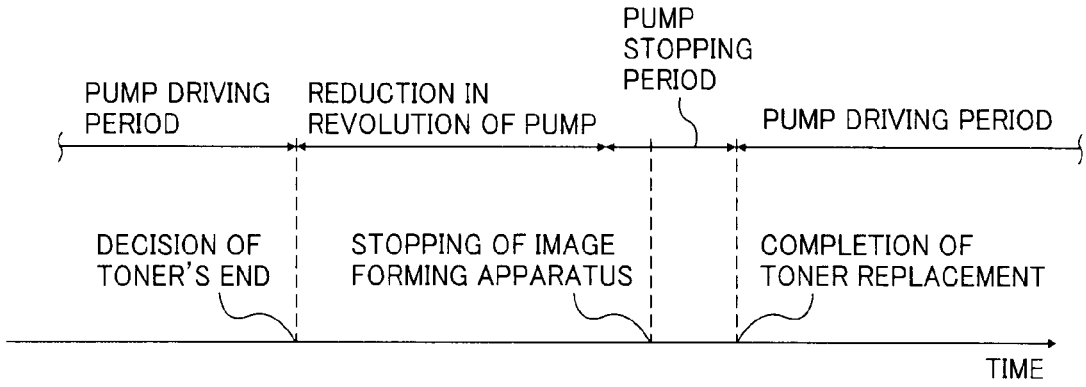
FIG. 14 is a timing chart for explaining drive controlling of a toner pump used for Example 3 of the image forming apparatus of the present invention.

FIG. 14 is another timing chart for explaining drive controlling of the toner pump 60 of the toner supplying device 500 of the copier 100 in this example.

In this example, when the controller 600 makes a toner end decision on the basis of the signal sent from the toner sensor 610 provided on the sub-hopper 68, the copier notifies the user by displaying a toner end message. After the toner end decision is made, the copier 100 continues the image forming operations for a while using the toner remaining in the sub-hopper 68. In this example, the copier produces 400 images after the toner end decision is made, and then stops the image forming operation.

As illustrated in FIG. 14, after the toner end decision, the number of revolution of the toner pump 60 is decreased, for example, by decreasing the number of revolution of the driving motor 66 serving as a driving source of the toner pump 60. After the toner pump 60 is operated under such a restricted condition for a while, the toner pump 60 is stopped before or at the same time the copier is stopped.

In the toner supplying device 500, the toner pump 60 is rotated at a revolution of from 200 to 400 rpm in the normal driving period (i.e., in the pump driving period in FIG. 14). After the toner end decision is made, the toner pump 60 is rotated at a relatively low revolution of from 100 to 200 rpm. In this regard, the revolution of the pump after the toner end decision is determined depending on the properties (preferably heat resistance) of the toner used.

By using this method, occurrence of the problem in that the internal temperature of the toner pump 60 increases due to friction between the rotor and stator, resulting in aggregation of the toner therein, thereby seriously abrading the stator 69 can be prevented.

Thus, the image forming apparatus of the present invention may be an image forming apparatus including an image bearing member configured to bear an electrostatic image thereon; a developing device, which has a developer containing portion containing a developer including at least a toner and which is configured to develop the electrostatic image with the developer to form a toner image on the image bearing member; and a toner supplying device configured to supply a developer supplement including at least the toner to the developer containing portion, and including: a toner container containing the developer supplement; a feeding passage configured to connect the toner container with the developer containing portion; a pump, in which a first member is moved while rubbing a second member to feed the developer supplement from the toner container to the developer containing portion through the feeding passage; and a residual toner detector configured to detect an amount of the developer supplement remaining in the toner container to determine whether the toner container is in a near-empty state, wherein even after the residual toner detector determines that the toner container is in a near-empty state, the image forming apparatus continues the image forming operations as long as a predetermined condition is satisfied while decreasing the driving speed of the pump (i.e., decreasing the moving speed of the first member of the pump).

Example 4

Another method for controlling increase of the internal temperature of a screw pump will be explained by reference to drawing.

Figure 15:
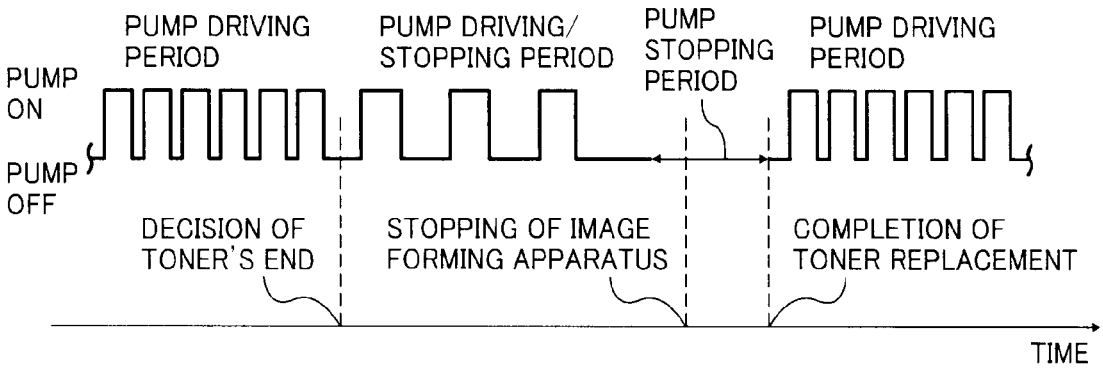
FIG. 15 is a timing chart for explaining drive controlling of a toner pump used for Example 4 of the image forming apparatus of the present invention.

FIG. 15 is another timing chart for explaining drive controlling of the toner pump 60 of the toner supplying device 500 of the copier 100 in this example.

In this example, when the controller 600 makes a toner end decision on the basis of the signal sent from the toner sensor 610 provided on the sub-hopper 68, the copier notifies the user by displaying a toner end message. After the toner end decision is made, the copier 100 continues the image forming operations for a while using the toner remaining in the sub-hopper 68. In this example, the copier produces 400 images after the toner end decision is made, and then stops the image forming operation.

As illustrated in FIG. 15, after the toner end decision, the periods of one driving operation and one stopping operation of the toner pump 60 are prolonged. Specifically, in this example, the period of one driving operation is 10 seconds after the toner end decision whereas the period is 2 seconds before the toner end decision (i.e., in the normal driving operation). By prolonging the period of one driving operation, the number of drive starting and stopping operations per a unit time can be decreased. In this regard, at the start of driving, the suction power of the toner pump 60 is not so strong but the rotor 61 rubs the stator 69. Therefore, the stator 69 is easily abraded and frictional heat is easily generated. By using the above-mentioned method, the time period during which frictional heat is generated by the rotor and stator can be reduced.

In addition, in this example, the period of one stopping operation following one driving operation is 20 seconds after the toner end decision whereas the period is 0.2 seconds before the toner end decision (i.e., in the normal driving operation). By prolonging the pump stopping period, the toner pump 60 can be well cooled.

As mentioned above, since the time period during which frictional heat is generated by the rotor and stator is shortened while the time period during which the toner pump is cooled is prolonged, occurrence of the problem in that the internal temperature of the toner pump increases can be prevented. By using this method, occurrence of the problem in that the internal temperature of the toner pump 60 increases due to friction between the rotor and stator, resulting in aggregation of the toner therein, thereby seriously abrading the stator 69 can be prevented.

In addition, the stator 69 is easily abraded at the beginning and end of the driving operations. In this example (Example 4), the number of the driving and stopping operations is reduced by prolonging the pump driving period of the mohno pump to reduce the degree of abrasion of the stator 69.

The prolonged pump driving period and pump stopping period are determined depending on the properties (preferably, heat resistance) of the toner used.

As mentioned above, the toner bottle 120 preferably contains premixed toner including a carrier and a toner. The purpose of using a premix toner is to prolong the life of the developer in the developing device 4. Specifically, by supplying a premix toner to the developing device 4, the carrier in the developer in the developing device is replaced little by little with a fresh carrier included in the supplied premix toner. Therefore, the developer in the developing device can maintain good developing property, thereby producing high quality images for a long period of time.

However, since the main component of the carrier is iron (Fe), it is possible that abrasion of the stator 69 made of a rubber is accelerated by the carrier, resulting in deterioration of the suction power of the toner pump 60. Although the copier 100 uses a premix toner, the copier hardly causes such a stator abrasion problem because of controlling increase of the internal temperature of the toner pump 60 after a toner end decision.

In the above explanation, the toner supplying device 500 directly sucks the premix toner in the toner bottle 120 by a negative pressure formed by the toner pump 60. However, the toner supplying device is not limited thereto. For example, it is possible to use a toner supplying device including a toner receiving portion, which is located on an uppermost stream portion in the toner supplying device and receives the toner (or premix toner) from a toner bottle, wherein the toner in the toner receiving portion is sucked through a toner feeding passage by forming a negative pressure using a screw pump. In addition, the toner pump 60 is not limited to a screw pump, and any devices in which one of at least two members is moved while rubbing the other member to form a negative pressure at a suction opening can be used. Specific examples of such devices include Roots-type blowers, rotary compressors, vane compressors, etc.

As mentioned above, the copier 100 serving as an image forming apparatus includes the developing device 4 which develops an electrostatic latent image formed on the photoreceptor 1 serving as a latent image bearing member using the developer included in the developing device; and the toner supplying device 500 configured to supply the toner (preferably, premix toner) to the developer containing portion of the developing device 4. The toner supplying device 500 includes the toner bottle 120 serving as a toner container, and the toner supplying tube 65, which serves as a toner feeding passage and which connects the toner bottle 120 with the developer containing portion. The toner supplying device 500 further includes the toner pump 60 serving as a pumping device in which one (rotor 61) of at least two members moves while rubbing the other member (stator 69) to form a negative pressure at the toner suction opening 63, thereby feeding the toner through the toner supplying tube 65 due to airflow in the toner supplying tube.

In addition, the copier 100 further includes the toner sensor 610 serving as a residual toner detector configured to detect the amount of residual toner in the toner bottle 120 by detecting a property influenced by the amount of the toner fed by the toner pump 60, and the controller 600 configured to control the operations of the copier. In the copier 100, the property influenced by the amount of the toner fed by the toner pump 60 is the amount of the toner in the sub-hopper 68. Even after the controller 600 makes a toner end decision such that the toner in the toner bottle is in a near-empty state, the controller permits the copier to produce a predetermined number of images (for example, 400 images). This is one example of the above-mentioned predetermined condition to be satisfied.

In Example 1, after the toner end decision, the toner pump 60 is stopped to prevent the internal temperature of the toner pump from increasing due to decrease of the toner fed through the toner pump. Therefore, occurrence of the problem in that the toner in the toner pump is melted and aggregated, thereby abrading the stator 69, resulting in decrease of the suction power of the toner pump can be prevented.

In Example 2, after the toner end decision, driving of the toner pump is controlled such that the ratio (S/D) of the stopping period (S) to the driving period (D) is greater than that before the residual toner detector makes the near-empty detection. By using this method, the time period during which the toner pump is heated by the frictional heat caused by the friction between the rotor and stator can be reduced. Therefore, increase of the internal temperature of the toner pump due to decrease of the toner fed through the toner pump can be controlled, and occurrence of the problem in that the toner in the toner pump is melted and aggregated, thereby abrading the stator 69, resulting in decrease of the suction power of the toner pump can be prevented.

In Example 3, after the toner end decision, the revolution of the rotor 61 of the toner pump 60 is relatively decreased compared to that in the normal toner supplying operation. By using this method, the quantity of frictional heat caused by the toner pump 60 per unit time can be reduced. Therefore, increase of the internal temperature of the toner pump due to decrease of the toner fed through the toner pump can be controlled, and occurrence of the problem in that the toner in the toner pump is melted and aggregated, thereby abrading the stator 69, resulting in decrease of the suction power of the toner pump can be prevented.

In Example 4, after the toner end decision, each of the pump driving period and the pump stopping period is relatively prolonged compared to those in the normal toner supplying operation. By using this method, the frequency of repetition of pump driving and stopping can be reduced, and thereby the quantity of frictional heat caused by the toner pump 60 per unit time can be reduced. In addition, since the pump stopping period is prolonged, the toner pump can be well cooled. Therefore, increase of the internal temperature of the toner pump due to decrease of the toner fed through the toner pump can be controlled, and occurrence of the problem in that the toner in the toner pump is melted and aggregated, thereby abrading the stator 69, resulting in decrease of the suction power of the toner pump can be prevented.

In addition, the toner pump 60 of the toner supplying device 500 is a screw pump including the stator 69 made of an elastic material and having a spiral groove on the cylindrical inner surface thereof and the rotor 61 which is made of a metal and which rotates in the stator while rubbing the inner surface of the stator to feed the toner in the axial direction thereof. By using a screw pump for the toner pump 60, space can be saved.

The toner contained in the toner bottle 120 is preferably a toner prepared by a method including dissolving or dispersing toner components including at least a polyester prepolymer including a functional group having a nitrogen atom, a polyester, a colorant, and a release agent in an organic solvent to prepare a toner composition liquid, and subjecting the toner composition liquid to a crosslinking reaction and/or a polymer chain growth reaction in an aqueous medium. The toner has good low temperature fixability. By using the toner, the fixing temperature can be decreased, resulting in energy saving of the copier 100.

The toner contained in the toner bottle 120 is preferably a premix toner including a carrier and a toner, wherein the concentration of the toner is higher than that in the developer contained in the developing device 4. In this case, the carrier in the developer in the developing device 4 can be replaced with a fresh carrier little by little. Therefore, the developer in the developing device 4 can maintain good developing property, resulting in formation of high quality images for a long period of time.

This document claims priority and contains subject matter related to Japanese Patent Application No. 2007-239822, filed on Sep. 14, 2007, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus configured to perform image forming operations to produce an image, comprising:

an image bearing member configured to bear an electrostatic image thereon;

a developing device, which has a developer containing portion containing a developer including at least a toner and which is configured to develop the electrostatic image with the developer to form a toner image on the image bearing member; and a toner supplying device configured to supply a developer supplement including at least the toner to the developer containing portion, comprising:

a toner container containing the developer supplement;

a feeding passage configured to connect the toner container with the developer containing portion;

a pump, in which a first member is moved while rubbing a second member to feed the developer supplement from the toner container to the developer containing portion through the feeding passage; and a residual toner detector configured to detect an amount of the developer supplement remaining in the toner container to determine whether the toner container is in a near-empty state, wherein even after the residual toner detector determines that the toner container is in a near-empty state, the image forming apparatus continues the image forming operations as long as a predetermined condition is satisfied while stopping the pump.

2. The image forming apparatus according to claim 1, wherein the pump is a screw pump including a rotor and a stator as the first and second members, respectively, and wherein the stator is a cylindrical elastic material having a spiral groove on an inner surface thereof, and the rotor rotates while rubbing the inner surface of the stator to feed the developer supplement toward an axial direction of the rotor.

3. The image forming apparatus according to claim 1, wherein the toner is prepared by a method including dissolving or dispersing toner components including at least a polyester prepolymer including a functional group having a nitrogen atom, a polyester, a colorant, and a release agent in an organic solvent to prepare a toner composition liquid, and subjecting the toner composition liquid to a crosslinking reaction, a polymer chain growth reaction, or a combination of a crosslinking reaction and a polymer chain growth reaction in an aqueous medium.

4. The image forming apparatus according to claim 1, wherein the developer in the developer containing portion of the developing device includes a carrier and a toner, and the developer supplement in the toner container includes the carrier and the toner, and wherein a ratio (T/C) of the toner (T) to the carrier (C) in the developer supplement is greater than that in the developer in the developer containing portion.

5. An image forming apparatus configured to perform image forming operations to produce an image, comprising:

an image bearing member configured to bear an electrostatic image thereon;

a developing device, which has a developer containing portion containing a developer including at least a toner and which is configured to develop the electrostatic image with the developer to form a toner image on the image bearing member; and a toner supplying device configured to supply a developer supplement including at least the toner to the developer containing portion, comprising:

a toner container containing the developer supplement;

a feeding passage configured to connect the toner container with the developer containing portion;

a pump, in which a first member is moved while rubbing a second member to feed the developer supplement from the toner container to the developer containing portion through the feeding passage; and a residual toner detector configured to detect an amount of the developer supplement remaining in the toner container to determine whether the toner container is in a near-empty state, wherein even after the residual toner detector determines that the toner container is in a near-empty state, the image forming apparatus continues the image forming operations as long as a predetermined condition is satisfied while changing a condition of the pump such that a ratio (S/D) of a pump stopping period (S) to a pump driving period (D) is greater than that before the residual toner detector determines that the toner container is in the near-empty state.

6. The image forming apparatus according to claim 5, wherein the pump is a screw pump including a rotor and a stator as the first and second members, respectively, and wherein the stator is a cylindrical elastic material having a spiral groove on an inner surface thereof, and the rotor rotates while rubbing the inner surface of the stator to feed the developer supplement toward an axial direction of the rotor.

7. The image forming apparatus according to claim 5, wherein the toner is prepared by a method including dissolving or dispersing toner components including at least a polyester prepolymer including a functional group having a nitrogen atom, a polyester, a colorant, and a release agent in an organic solvent to prepare a toner composition liquid, and subjecting the toner composition liquid to a crosslinking reaction, a polymer chain growth reaction, or a combination of a crosslinking reaction and a polymer chain growth reaction in an aqueous medium.

8. The image forming apparatus according to claim 5, wherein the developer in the developer containing portion of the developing device includes a carrier and a toner, and the developer supplement in the toner container includes the carrier and the toner, and wherein a ratio (T/C) of the toner (T) to the carrier (C) in the developer supplement is greater than that in the developer in the developer containing portion.

9. An image forming apparatus configured to perform image forming operations to produce an image, comprising:

an image bearing member configured to bear an electrostatic image thereon;

a developing device, which has a developer containing portion containing a developer including at least a toner and which is configured to develop the electrostatic image with the developer to form a toner image on the image bearing member; and a toner supplying device configured to supply a developer supplement including at least the toner to the developer containing portion, comprising:

a toner container containing the developer supplement;

a feeding passage configured to connect the toner container with the developer containing portion;

a pump, in which a first member is moved while rubbing a second member to feed the developer supplement from the toner container to the developer containing portion through the feeding passage; and a residual toner detector configured to detect an amount of the developer supplement remaining in the toner container to determine whether the toner container is in a near-empty state, wherein even after the residual toner detector determines that the toner container is in a near-empty state, the image forming apparatus continues the image forming operations as long as a predetermined condition is satisfied while changing a condition of the pump such that a pump stopping period (S) and a pump driving period (D) are longer than those before the residual toner detector determines that the toner container is in the near-empty state.

10. The image forming apparatus according to claim 9, wherein the pump is a screw pump including a rotor and a stator as the first and second members, respectively, and wherein the stator is a cylindrical elastic material having a spiral groove on an inner surface thereof, and the rotor rotates while rubbing the inner surface of the stator to feed the developer supplement toward an axial direction of the rotor.

11. The image forming apparatus according to claim 9, wherein the toner is prepared by a method including dissolving or dispersing toner components including at least a polyester prepolymer including a functional group having a nitrogen atom, a polyester, a colorant, and a release agent in an organic solvent to prepare a toner composition liquid, and subjecting the toner composition liquid to a crosslinking reaction, a polymer chain growth reaction, or a combination of a crosslinking reaction and a polymer chain growth reaction in an aqueous medium.

12. The image forming apparatus according to claim 9, wherein the developer in the developer containing portion of the developing device includes a carrier and a toner, and the developer supplement in the toner container includes the carrier and the toner, and wherein a ratio (T/C) of the toner (T) to the carrier (C) in the developer supplement is greater than that in the developer in the developer containing portion.

* * * * *